US012157588B2

(12) United States Patent
Westarp

(10) Patent No.: US 12,157,588 B2
(45) Date of Patent: Dec. 3, 2024

(54) DISPLACEMENT DEVICE AND METHOD FOR DISPLACEMENT

(71) Applicant: HAVER & BOECKER OHG, Oelde (DE)

(72) Inventor: Christian Westarp, Oelde (DE)

(73) Assignee: HAVER & BOECKER OHG, Oelde (DE)

( * ) Notice: Subject to any disclaimer, the term of this patent is extended or adjusted under 35 U.S.C. 154(b) by 79 days.

(21) Appl. No.: 17/998,379

(22) PCT Filed: May 11, 2021

(86) PCT No.: PCT/EP2021/062438
§ 371 (c)(1),
(2) Date: Nov. 10, 2022

(87) PCT Pub. No.: WO2021/228827
PCT Pub. Date: Nov. 18, 2021

(65) Prior Publication Data

US 2023/0271737 A1 Aug. 31, 2023

(30) Foreign Application Priority Data

May 13, 2020 (DE) ..... 102020112987.4
Dec. 14, 2020 (DE) ..... 102020133377.3

(51) Int. Cl.
*B65B 43/46* (2006.01)
*B65B 1/06* (2006.01)

(52) U.S. Cl.
CPC ..... *B65B 43/465* (2013.01); *B65B 1/06* (2013.01)

(58) Field of Classification Search
CPC ..... B65B 1/06; B65B 43/465
See application file for complete search history.

(56) References Cited

U.S. PATENT DOCUMENTS 4,448,011 A 5/1984 Pohl
4,510,736 A 4/1985 Müller
(Continued)

FOREIGN PATENT DOCUMENTS

AU 454509 B2 10/1974
DE 102007021786 A1 11/2007
(Continued)

OTHER PUBLICATIONS

International Search Report and Written Opinion received for PCT/EP2021/062438, mailed Sep. 2, 2021.
(Continued)

*Primary Examiner* — Timothy L Maust
(74) *Attorney, Agent, or Firm* — Greer, Burns & Crain, Ltd

(57) ABSTRACT

A displacement device for a handling device, including an articulation mechanism on which the handling device is accommodated, wherein the handling device is displaceable by the articulation mechanism between a first position and a second position. The articulation mechanism has a four-pivot arrangement with a first link and a second link, wherein the first link is connected to the second link via a coupler. The coupler has a receiving section for receiving the handling device, wherein the first link, the second link and the coupler are matched to one another so that a substantially rectilinear displacement of the handling device takes place from the first position into the second position. In a method for displacement of a handling device by such a displacement device, the handling device is displaced substantially rectilinearly by the articulation mechanism between the first position and the second position. A packaging machine includes the displacement device.

10 Claims, 17 Drawing Sheets

(56) References Cited

U.S. PATENT DOCUMENTS

| | | | | |
|---|---|---|---|---|
| 5,398,484 | A | 3/1995 | Kader | |
| 5,878,553 | A * | 3/1999 | Schlosser | B65B 43/16 53/469 |
| 6,138,723 | A * | 10/2000 | Wagner | B65B 43/465 53/570 |
| 6,295,790 | B1 | 10/2001 | McGregor et al. | |
| 6,401,439 | B1 | 6/2002 | Tetenborg et al. | |
| 6,474,050 | B1 | 11/2002 | Tetenborg | |
| 7,764,891 | B2 | 7/2010 | Du et al. | |
| 7,861,499 | B2 | 1/2011 | Combrink et al. | |
| 7,954,307 | B2 | 6/2011 | Paunesku et al. | |
| 8,261,785 | B2 * | 9/2012 | Koga | B65B 43/465 141/10 |
| 9,352,860 | B2 | 5/2016 | Vollenkemper et al. | |
| 9,802,724 | B2 | 10/2017 | Vollenkemper | |
| 11,273,942 | B2 | 3/2022 | Schütte et al. | |
| 11,305,904 | B2 | 4/2022 | Gallaun et al. | |
| 2019/0300216 | A1 | 10/2019 | Nakamoto | |
| 2019/0375530 | A1 | 12/2019 | Mora Flores et al. | |
| 2020/0062429 | A1 | 2/2020 | Felling et al. | |
| 2020/0369417 | A1 | 11/2020 | Pieper et al. | |

FOREIGN PATENT DOCUMENTS

| | | | |
|---|---|---|---|
| DE | 102008014489 | A1 | 9/2009 |
| DE | 102011002808 | A1 | 7/2012 |
| DE | 102013105603 | A1 | 12/2014 |
| EP | 1857369 | A2 | 11/2007 |
| EP | 2117781 | A1 | 11/2009 |
| EP | 2132095 | A1 | 12/2009 |
| EP | 3715267 | A1 | 9/2020 |
| IT | MI20121877 | A1 | 5/2014 |
| JP | 2002143794 | A | 5/2002 |

OTHER PUBLICATIONS

German Search Report received for 102020133472.9, dated Aug. 6, 2021.

German Search Report received for 102020112987.4, dated Feb. 19, 2021.

* cited by examiner

DISPLACEMENT DEVICE AND METHOD FOR DISPLACEMENT

The present invention relates to a displacement device for at least one handling device, in particular for a gripper device of a packing machine, comprising at least one articulation mechanism on which the handling device is accommodated. In this case, the handling device is displaceable by means of the articulation mechanism between at least one first position and at least one second position. The present invention additionally relates to a method for displacement of a handling device using such a displacement device and a packing machine with such a displacement device.

In many machines, components and in particular tools or other processing and/or handling modules are moved to and fro between different positions in order to perform a processing and/or convey items or products from one position into another.

For example, in automatic and/or partially automatic packing machines, e.g. for filling bulk material into bags, according to the configuration, for example, an empty bag is grasped from a supply by a gripper device and attached to a filling nozzle. The filled bag can then be conveyed by the gripper device, e.g. to a closure station or the like.

Depending on the configuration of the packing machine and/or depending on the arrangement of the individual assemblies with respect to one another, it is frequently necessary to displace the gripper device or the gripper arm forwards and backwards.

In packing machine, for example, for conveying a filled bag from the filling nozzle to a closure station, displacement systems have become known which have a parallelogram-shaped articulation mechanism in order to displace the bag.

A disadvantage with such systems however is that due to the polygon effect a lifting movement of the articulation mechanism also acts on the bag, with the result that the shape or the volume of the bag changes at least temporarily. As a result of the raising and lowering of the head region, air turbulence can occur. This can result in an undesired escape of product.

In particular, when the bag is conveyed to a closure station and the area of the subsequent bag seam has already been cleaned, the escape of product and therefore contamination of the subsequent seam area should be avoided.

It is the object of the present invention to improve the disadvantages described previously.

SUMMARY

The displacement device according to the invention for at least one handling device, in particular for a gripper device of a packing machine comprises at least one articulation mechanism on which the handling device is accommodated. In this case, the handling device is displaceable by means of the articulation mechanism between at least one first position and at least one second position. According to the invention, the articulation mechanism comprises at least one four-pivot arrangement with at least one first link and at least one second link, wherein the first link is connected to the second link via at least one coupler. In this case, the coupler comprises at least one receiving section for receiving the handling device, wherein in the geometries the first link, the second link and the coupler are matched to one another in such a manner that a substantially rectilinear displacement or displacement movement of the handling device takes place from the first position into the second position.

The handling device is in particular a processing device, a handling device such as a machine, a tool a processing assembly, a gripper device and/or the like which can be moved to and fro by means of the articulation mechanism.

In particular, the handling device is encompassed by the displacement device or is a part thereof. However, depending on the configuration a separate handling device can also be provided which is accommodated or fastened on the displacement device or on the articulation mechanism.

The arrangement of the links and the couplers to one another is at least temporarily parallelogram-like or trapezoidal, wherein parallelogram-like or trapezoidal should not be understood such that it actually comprises a parallelogram or a trapezium. In at least one position, the two links can be parallel to one another.

The articulation mechanism or the four-pivot arrangement is in particular configured in the manner of a mechanical linkage so that a particularly reliable, stable and determined displacement can take place from the first position into the second position and back.

The displacement device according to the invention offers many advantages. A considerable advantage is that due to the special configuration of the articulation mechanism or due to the special configuration of the links and the couplers with respect to one another, a substantially rectilinear displacement of the handling device and therefore in the example of a gripper device, a substantially rectilinear movement of a filled bag attached to the gripper device is made possible.

In conventional displacement systems with an articulation mechanism in the manner of a parallelogram or the like, a raising and lowering of the handling device occurs during the movement of the handling device due to the polygon effect, with the result that these forces also act on the bag attached to the handling device. In this case, the end points usually lie lower than the lifting movement. In the other case when the end points lie higher than the middle oscillation position, a lifting movement would also result. In both cases, the volume of the bag interior would briefly change which results in the escape or pumping out of product and therefore in a re-contamination of the previously cleaned bag seam area.

In this case, it is the case that the transport path is accomplished substantially rectilinearly by the special configuration of the articulation mechanism wherein however, depending on the configuration, the handling device can tilt slightly preferably during the displacement which, however does not result in a change in the lift or a change in the vertical alignment so that no lifting movement is triggered. In this case, it is particularly preferred that at least one point of the coupler is displaced rectilinearly or linearly. Then, depending on the configuration, the remainder can then tilt slightly about this point, usually the central axis of the handling device or the gripper device, according to position.

Preferably the first link and the second link are different lengths. In this case, in particular the first link is shorter than the second link. Preferably the shorter link, in particular in the first position or the basic position, is further removed from the second position than the second link.

Particularly preferably the lower articulation point of the first link and the lower articulation point of the second link are arranged at different heights. In this case, in particular the first link or the second link is arranged higher or the lower articulation point of this link is arranged higher.

It is further preferred that the free ends or the lower articulation points of the links are accommodated in an articulated manner on a housing or a frame.

In advantageous further developments, the coupler has at least one first section and at least one second section, wherein the first section and the second section can be arranged at an angle with respect to one another and in particular can be arranged angled with respect to one another. In particular, a rectilinear movement of the handling device can be achieved due to such a configuration.

Preferably the first link with a second articulation point is accommodated in an articulated manner on a first section of the coupler and the second link with its second articulation point is accommodated in an articulated manner between the first and the second section of the coupler and/or on the second section of the coupler.

Preferably the receiving section for receiving the handling device is arranged on the second section of the coupler. As a result of the arrangement of the handling device on this section, a particularly rectilinear displacement of the handling device is ensured.

In expedient further developments the arrangement of the second articulation point of the first link on the first section and the second articulation point of the second link on the second section of the coupler are matched to one another. In this case, in particular, the configuration of the coupler, the dimensioning of the links and the attachment of the links are matched to one another.

Preferably at least one actuator device is provided. By means of such an actuator device the articulation mechanism and therefore the handling device can be conveyed from the first position into the second position and back.

Particularly preferably the actuator device comprises at least one pneumatic device. This pneumatic device can in particular comprise at least one pressure cylinder or a pneumatic cylinder or be provided by such.

The method according to the invention is suitable for the displacement of a handling device by means of a displacement device such as has been described previously. In this case, the handling device is displaced substantially rectilinearly by means of the articulation mechanism between the first and the second position.

In this case, rectilinear should be understood in particular to mean that no or substantially no height change or no lifting movement takes place between the first position and the second position. However, according to the configuration the handling device can tilt at least slightly about the rectilinearly moving point, which however results in no or no relative lifting movement.

The method according to the invention offers the advantages which have already been listed.

The packing machine according to the invention is suitable for filling product and in particular for filling bulk materials into bags and comprises at least one filling module with at least one filling nozzle, at least one displacement device as has been described previously and at least one handling device.

The packing machine according to the invention offers the advantages listed previously.

Further advantages and features of the present invention are obtained from the exemplary embodiment, which is explained hereinafter with reference to the appended figures.

DETAILED DESCRIPTION

Figure 1:
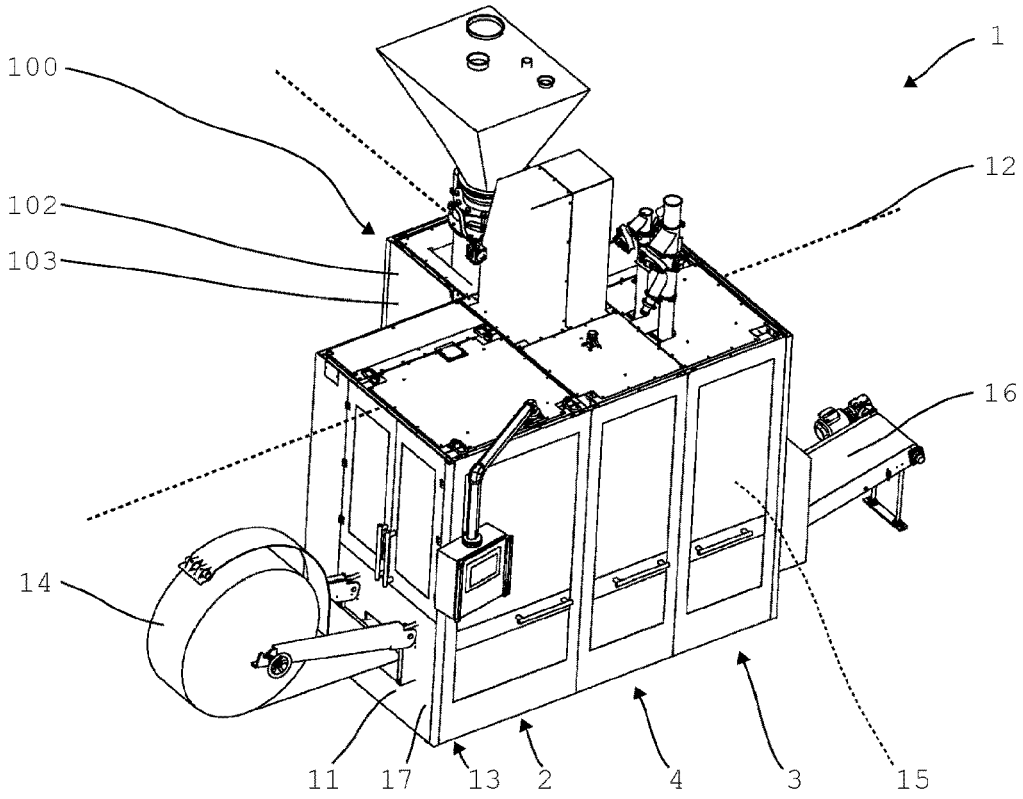
FIG. 1 shows a purely schematic diagram of an exemplary embodiment of a packing machine according to the invention in a perspective view.

FIG. 1 shows a packing machine 1 according to the invention in a perspective view. In this case, the packing machine 1 in the exemplary embodiment shown here comprises a bag supply 2, a bag removal 3 and an interposed transfer device 4. The bag supply 2, the bag removal 3 and the transfer device 4 are in this case arranged in a line 12.

A filling module 100 is provided, pulled out of line 12 and arranged in the exemplary embodiment shown here next to the transfer device 4. In the exemplary embodiment shown here, empty bags from the bag supply 2 are fed to the filling module 100 by means of the transfer device 4. The bag thus supplied to the filling module 100 is attached to the filling nozzle 101 of the filling module 100 and filled and guided by the transfer device 4 back into the line 12 and fed to the bag removal 3.

By arranging the filling module 100 next to the line or pulling out from the line, almost any filling module 100 can be used together with the modules or assemblies of the packing machine 1 arranged in the line 12. In particular, standard modules can also be used so that no special configuration of a filling module 100 must be provided for the packing machine according to the invention, preferably modules for filling open bags of any filling technology.

In the exemplary embodiment shown here, the packing machine 1 is provided encapsulated, for which the individual assemblies or modules are provided in housing devices 11, 102. In this case, in the exemplary embodiment shown here, the assemblies arranged in line 12, namely the bag supply 2, the bag removal 3 and the transfer device 4 are provided in a common housing device 11. In the exemplary embodiment shown here, the filling module 10 is provided in its own housing device 102.

By arranging the individual assemblies or modules in housing devices 11, 102, it is possible to hermetically seal off the filling process depending on the configuration so that hazardous or sensitive substances can also be filled by means of the packing machine 1. In particular, in the packing machine 1 or in the housing devices 11, 102 a vacuum can also be applied or a suction can take place so that product which escapes during filling does not escape into the environment but can be safely disposed of or even recycled.

In the exemplary embodiment shown here the bag supply 2 also comprises a bag production 13, wherein bags are produced for this purpose starting from a film supply 14 and made available to the transfer device 4.

In the exemplary embodiment shown here the bag removal 3 comprises a closing device 15, by means of which the filled and still open bags can be closed and a conveyor belt 16 for the removal of the filled and closed bags.

Since the bag supply 2, the bag removal 3 and the transfer device are arranged in a line 12 and the filling module 100 is arranged pulled out of this line 112, this results in a T-shaped arrangement of the packing machine 1 according to the invention.

As already mentioned previously, this offers many advantages. An advantage is that by juxtaposing the filling module 100 or by pulling out the filling module 100 from the line 12, almost any (standard) filling module can be used. As a result, on the one hand, existing filling modules 100 can be used. On the other hand, due to the juxtaposition a filling module can also be changed or exchanged quickly without too much effort. In known inline systems, i.e., systems in which everything is arranged in a line, for reasons of space it can be difficult to arrange the filling technology, in particular the air filling module 105 with pressure chamber 106 shown in the exemplary embodiment, in line. In addition, operability or maintainability would be more difficult.

Another advantage is that due to the T-shaped configuration or arrangement of the packing machine a particularly compact design is possible.

Figure 2:
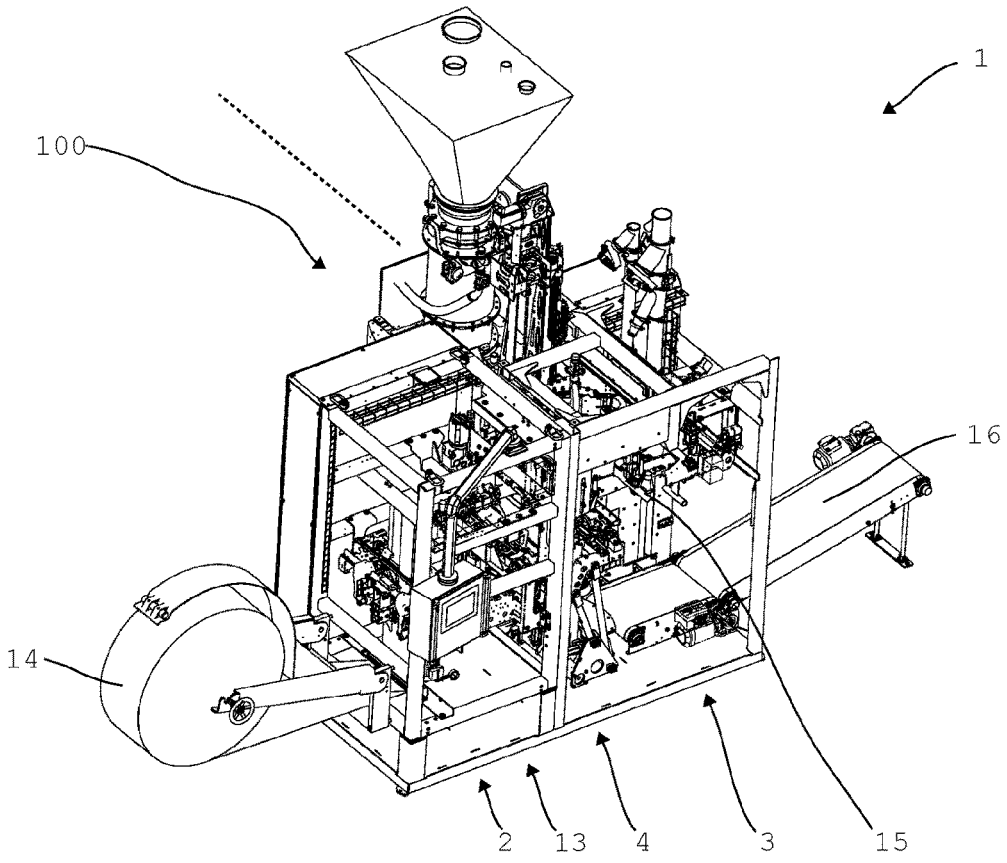
FIG. 2 shows a further purely schematic diagram of an exemplary embodiment of a packing machine according to the invention in a perspective view.
Figure 3:
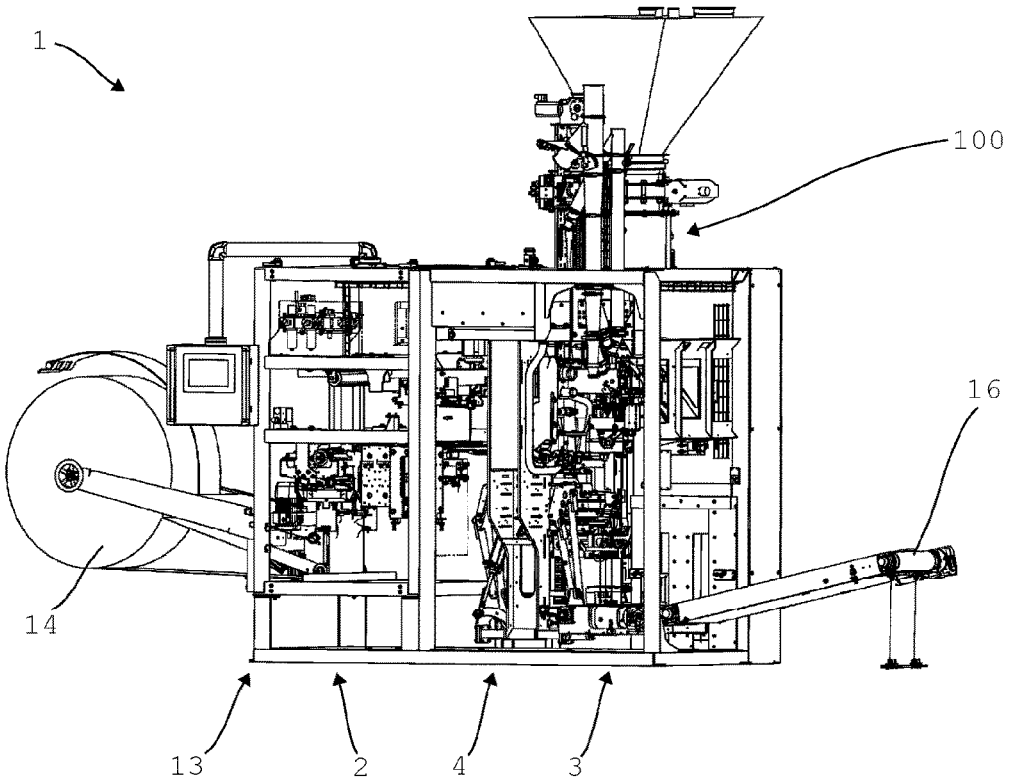
FIG. 3 shows a next purely schematic diagram of an exemplary embodiment of a packing machine according to the invention in a perspective view.
Figure 4:
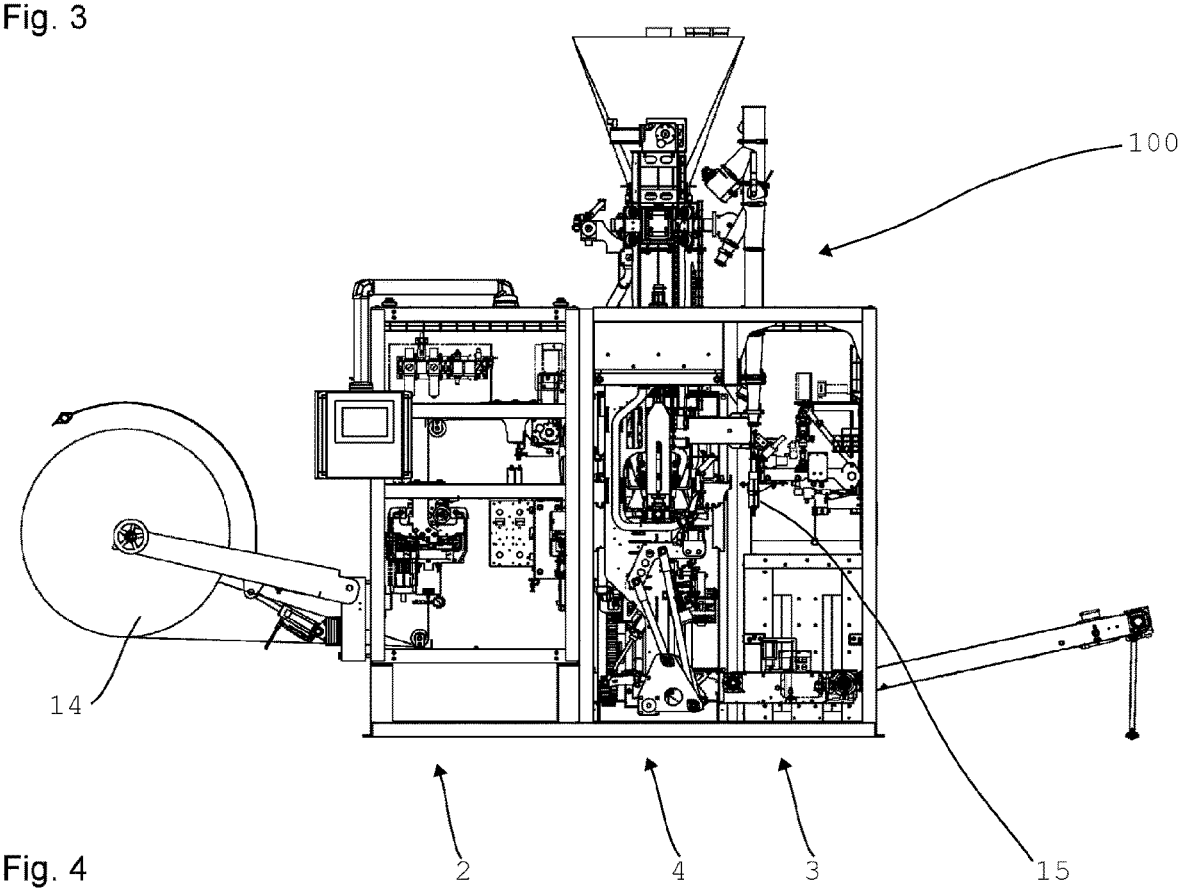
FIG. 4 shows a purely schematic diagram of an exemplary embodiment of a packing machine according to the invention in a view from the front.

For better illustration of the packing machine 1, FIGS. 2 to 4 show two perspective views and a front view of the packing machine 1, wherein in the housing devices 11, 102, the housing covers 17, 103 are not shown to provide overview views of the interior of the packing machine 1 or of the various modules or assemblies.

Figure 5:
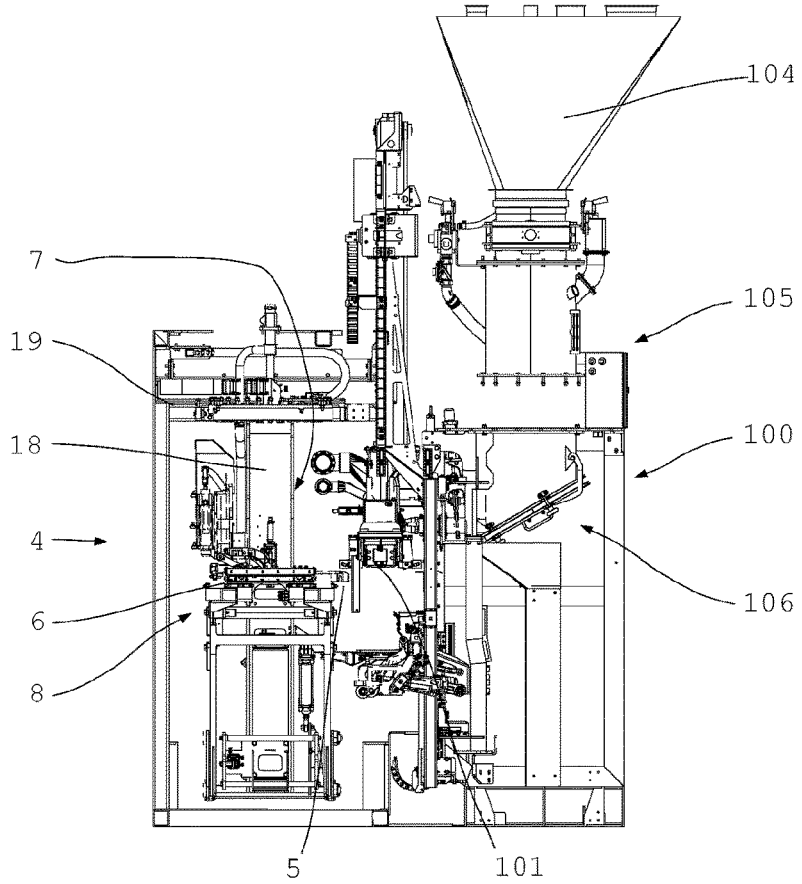
FIG. 5 shows a purely schematic diagram of an exemplary embodiment of a packing machine according to the invention in a view from the side of the bag removal.
Figure 6:
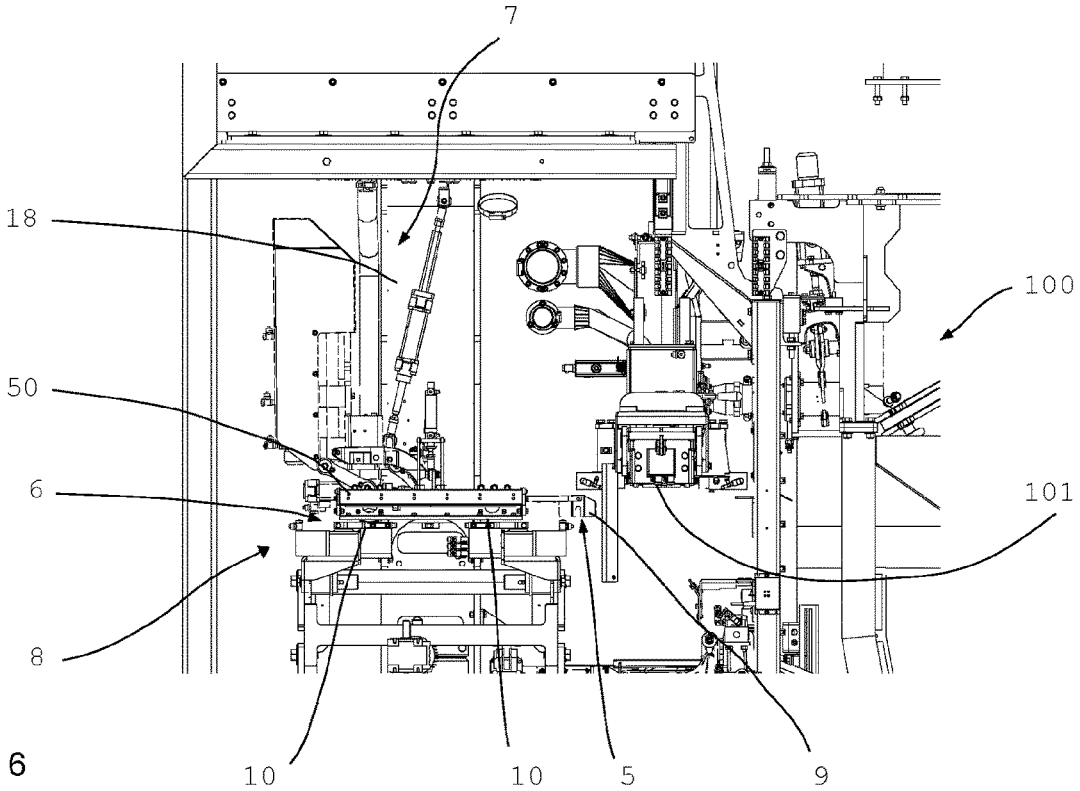
FIG. 6 shows a further purely schematic diagram of an exemplary embodiment of a packing machine according to the invention in a view from the side of the bag removal.

In FIGS. 5 and 6, the view of the transfer device 4 from the side of the bag removal 3 is shown once in an overview view and once in an enlarged diagram.

In this view, it can be seen that the filling module 100 is provided or arranged next to the transfer device 4, wherein the filling nozzle 101 of the filling module 100 can also be identified in this view. Here the inlet hopper 104 of the filling module 100 can also be seen, which is connected to a silo for product to be filled, which is located thereabove but not shown. In this case, product is fed via the inlet hopper 104 into the pressure chamber 106 inside the filling module 100 or here the air filling module 105 to the filling nozzle 101.

In this view it can be seen that the transfer device comprises a first gripper device 5 and a second gripper device 6, which are mounted on different sides 7, 8 of the transfer device 4 or on a base body 18 of the transfer device 4.

It is shown here that the base body 18 of the transfer device 4 is configured in a pillar-like manner here and is provided in a suspended manner in the exemplary embodiment shown here. In the exemplary embodiment shown, the base body 18 is suspended on rails 19, whereby the base body 19 with the gripper devices 5, 6 can be pulled out in this view to the left from the line 12. This displaceability of transfer device 4 will be shown and described in more detail later.

In addition to the displaceability of the transfer device 4 or the base body 18 of the transfer device 4, the base body 18 can also be rotated by 90° back and forth in the exemplary embodiment shown here. By turning back and forth the base body 18 of the transfer device 4 and by arranging the first gripper device 5 on one side 7 of the base body 18 and arranging the second gripper device 6 on the side 8 of the base body 18, by turning the base body 18 back and forth through 90° a bag from the bag supply 2 can be fed by means of the transfer device 4 out from line 12 to the filling module 100 or the filling nozzle 101. When the base body 18 or the transfer device 4 turns back, the second gripper device 6 comes in contact with the now filled bag at the filling nozzle 101 and can pick this up and can be guided back into the line 12 by turning forwards or re-turning the base body 18 and fed to the bag removal.

In the enlargement in FIG. 6 the first gripper device 5 and the second gripper device 6 can be identified on different sides 7, 8 of the base body 18 of the transfer device 4. One of the two gripper arms 9 of the first gripper device 5 can also be identified here.

Figure 7:
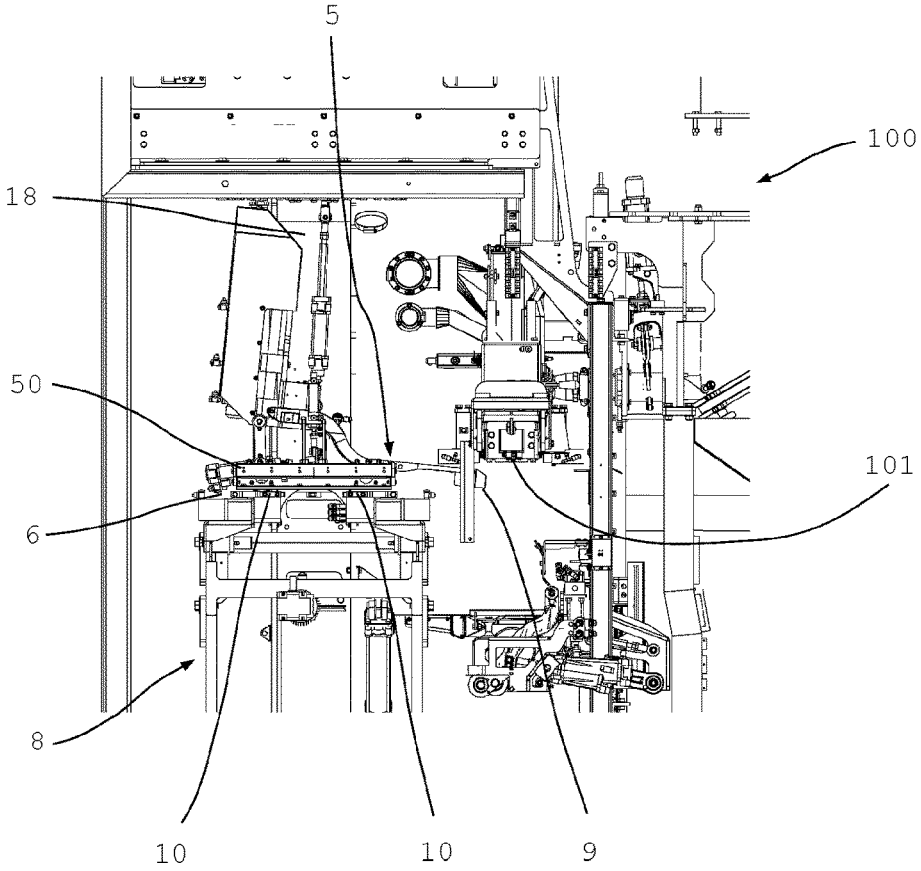
FIG. 7 shows a next purely schematic diagram of an exemplary embodiment of a packing machine according to the invention in a view from the side of the bag removal.
Figure 8:
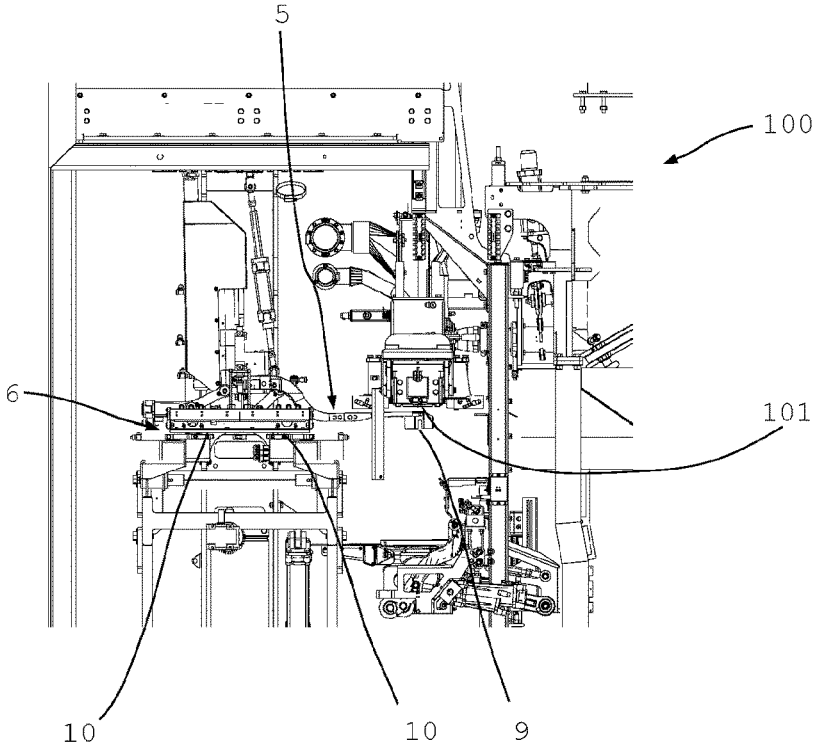
FIG. 8 shows another purely schematic diagram of an exemplary embodiment of a packing machine according to the invention in a view from the side of the bag removal.

As can be seen in more detail in the following figures, in the exemplary embodiment shown here the gripper device 5 comprises two gripper arms 9 which can be moved relative to each other so that they serve as a kind of spreader. Thus, it is possible that the gripper arms 9 of the first gripper device 5 pick up an open bag from the bag supply 2 or the bag production and attach this to the filling nozzle 101. For this purpose, the first gripper device 5 or for this purpose, the gripper arms 9 in the exemplary embodiment shown here can also be displaced forwards and pulled back again, which is shown purely schematically in FIGS. 7 and 8.

Figure 9:
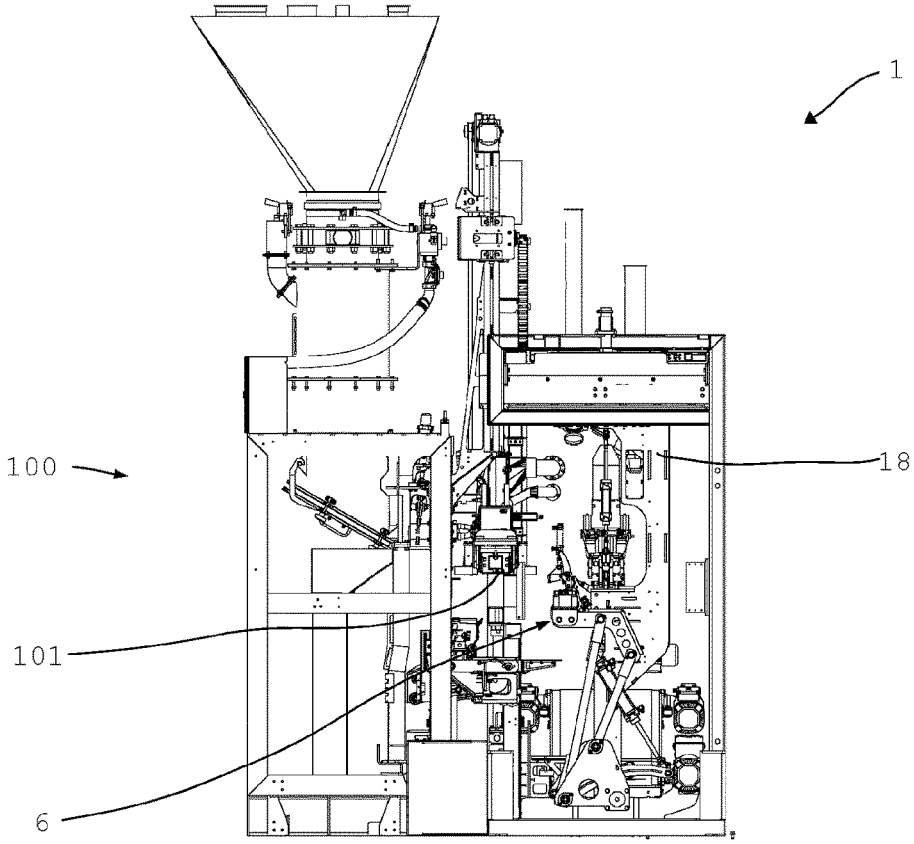
FIG. 9 shows a purely schematic diagram of an exemplary embodiment of a packing machine according to the invention in a view from the side of the bag supply.

FIG. 9 shows purely schematically the view of the transfer device 4 and the filling module 100 from the direction of the bag supply 2. In this case, the base body 18 of the transfer device 4 is rotated in such a manner that the second gripper device 6 is aligned in the direction of the filling nozzle 101 of the filling module 100. In this position, the first gripper device 5 is aligned in such a manner that it can receive an empty bag from the bag supply 2.

Figure 10:
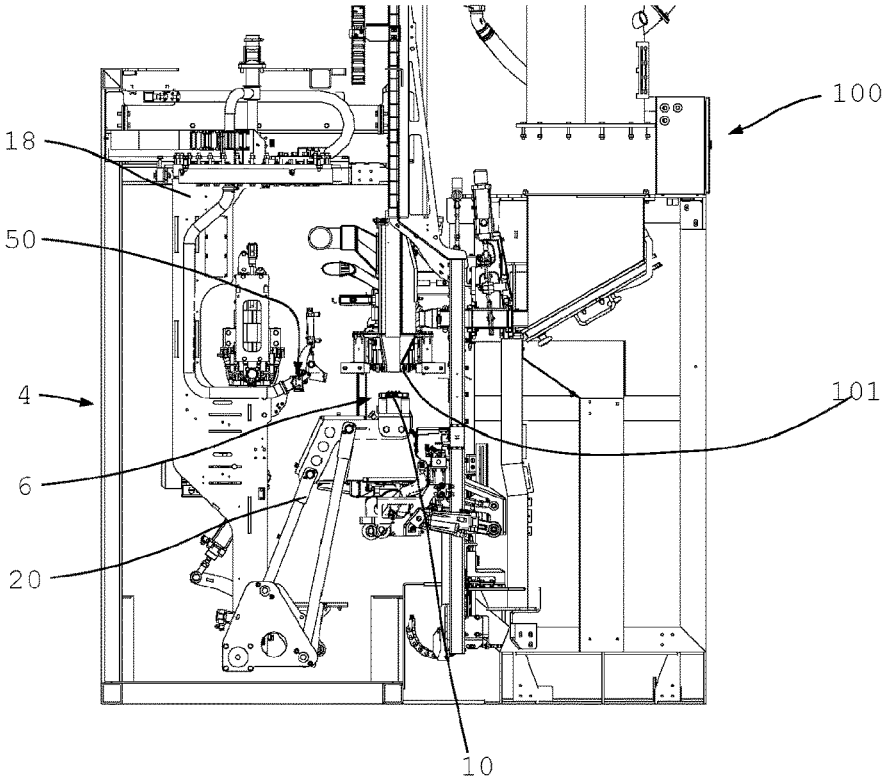
FIG. 10 shows a purely schematic diagram of an exemplary embodiment of a packing machine according to the invention in a view from the side of the bag removal.

FIG. 10 shows a purely schematic view of the transfer device 4 and the filling module 100 from the side of the bag removal 3.

Here it can be seen that the second gripper device 6 is provided to be displaceable so that the second gripper device 6 in the exemplary embodiment shown can be pivoted or displaced forwards via a parallelogram-like structure 20 in the direction of the filling nozzle 101. Thus, the clamping devices 10 of the second gripper device 6 can compress the still open bag walls of the filled bag and then displace the bag back in the direction of the base body 18.

Subsequently, the base body 18 can be rotated clockwise by 90° here so that the full bag can be displaced back into the line 12 and then fed to the bag removal. At the same time, during the removal of the full bag by the second gripper device 6, a new empty bag can be picked up by the first gripper device 5. When turning the full bag forwards into the line 12, a new empty bag is then simultaneously moved out of line 12 and fed to the filling nozzle 101.

In FIG. 10 it can also be seen that a cleaning device according to the invention 50 is provided above the second gripper device 6, which is explained in detail in the subsequent figures.

Figure 11:
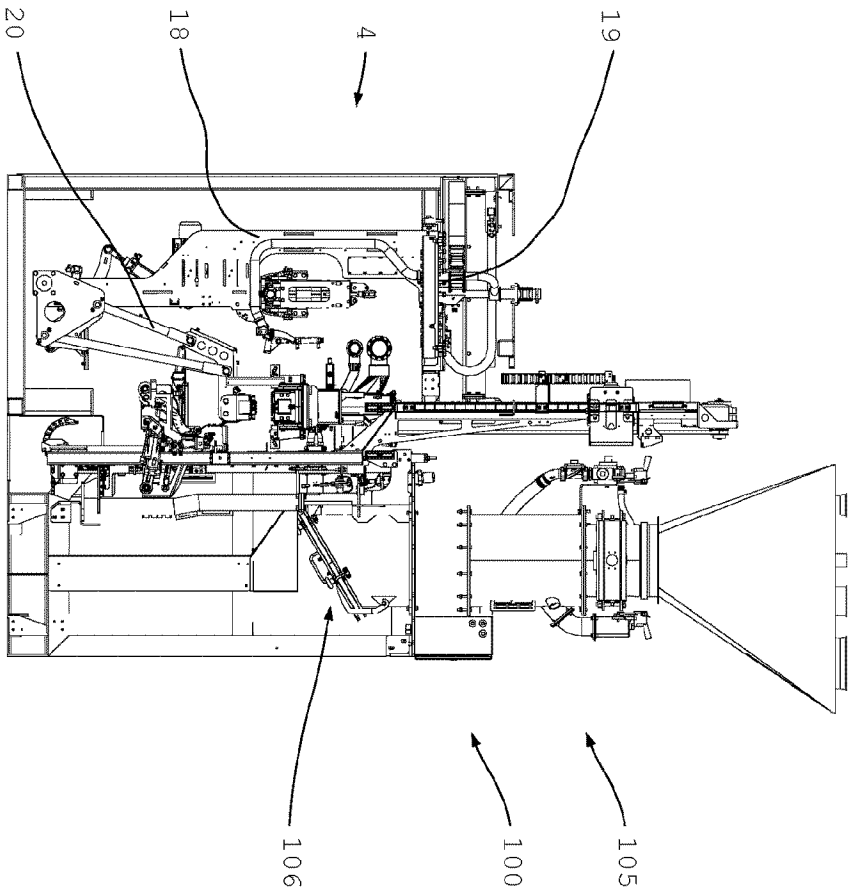
FIG. 11 shows a further purely schematic diagram of an exemplary embodiment of a packing machine according to the invention in a view from the side of the bag removal.
Figure 12:
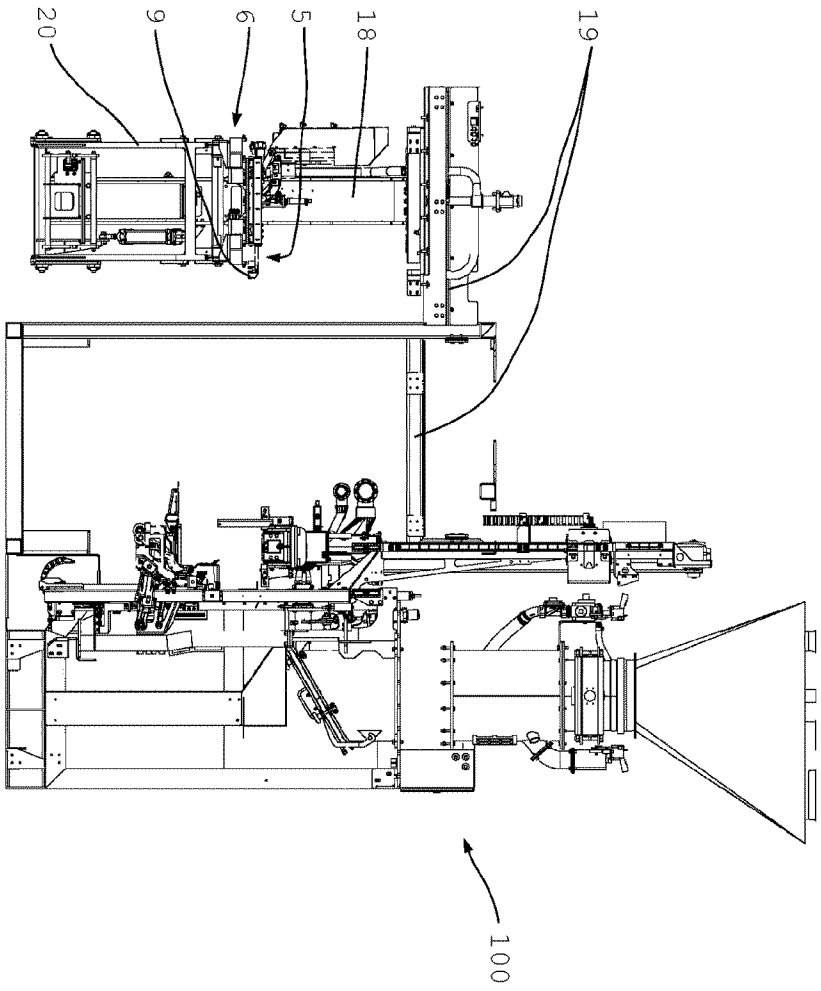
FIG. 12 shows the view according to FIG. 11 with pulled-out transfer device.

FIGS. 11 and 12 show purely schematically once again a side view of the packing machine 1 or of the transfer device 4 and the filling module 100 from the direction of the bag removal 3. When this view is compared, it can be seen that the transfer device 4 or the base body 18 together with the gripper devices 5, 6 fastened thereon is configured to be movable or extendable.

For this purpose, as already stated in the exemplary embodiment shown here, the base body 18 is suspended in an upper region and displaceable via a rail 19 or a rail system 19. Other technical components or components for displacing the base body 18 can be used analogously.

Since in the exemplary embodiment shown here, the transfer device 4 or the base body 18 of the transfer device 4 can be pulled out transversely to the line 12, for example, a sufficient space for maintenance staff is provided for maintenance of the packing machine 1.

Thus, in the extended state of the base body 18 in the exemplary embodiment shown here it is in particular possible to comfortably reach all the assemblies of the packing machine 1. In particular, the filling module 100 can be reached from the side of the filling nozzle 101. However, the bag supply 2, the bag removal and also the otherwise inaccessible side of the transfer device can be maintained and/or repaired.

Figure 13:
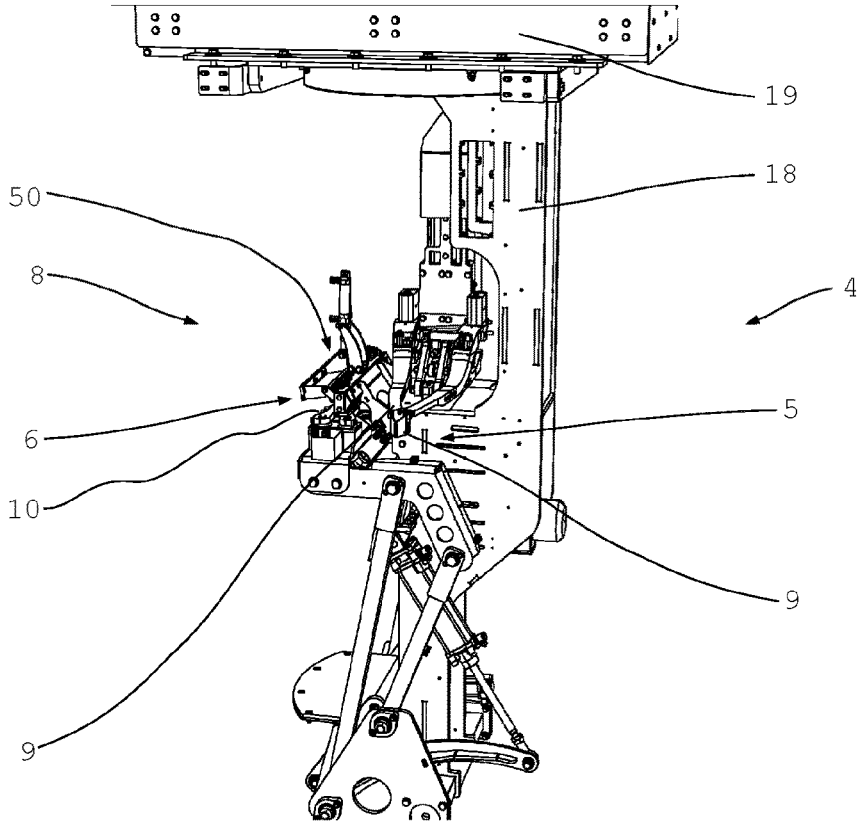
FIG. 13 shows a purely schematic diagram of an exemplary embodiment of a transfer device.
Figure 14:
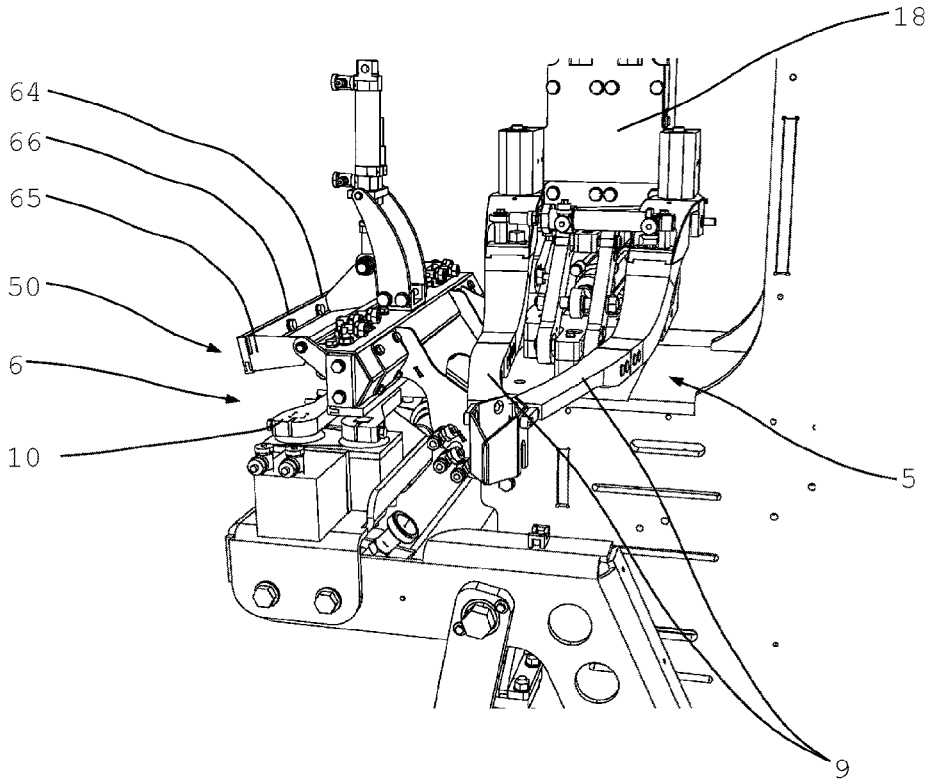
FIG. 14 shows an enlargement according to FIG. 13.

FIGS. 13 and 14 show the transfer device 4 or the base body 18 of the transfer device 4 of the packing machine 1 in an overview diagram and a detailed view.

The first gripper device 5 and the second gripper device 6 are arranged in this exemplary embodiment offset by 90° on the different sides 7, 8. As a result of this arrangement a superimposed operating mode of the empty bag and the full bag transfer or transport is ensured.

A cleaning device 50 is provided above the second gripper device 6, which comprises a housing device 64, wherein in the exemplary embodiment shown here a pivotable housing element 65 or a pivotable flap 66 is provided. The cleaning device 50 is explained in more detail in subsequent figures.

In addition, it can be seen that the first gripper device 5 is arranged on the side 7 of the base body 18, which, in the exemplary embodiment shown here, comprises two gripper arms 9, which can be moved here relative to each other or pivoted outwards or moved. Thus, the gripper arms act as spreaders and can pick up an empty bag from bag supply 2 or take it from this.

Furthermore, as can already be seen previously in the figures, the first gripper device 5 is provided to be pivotable so that this can be displaced forwards in the direction of the filling nozzle 101 and also in the direction of the bag supply 2. Depending on the configuration, for example, telescopic gripper arms 9 or other components of the first gripper device 5 can be provided.

Figure 15:
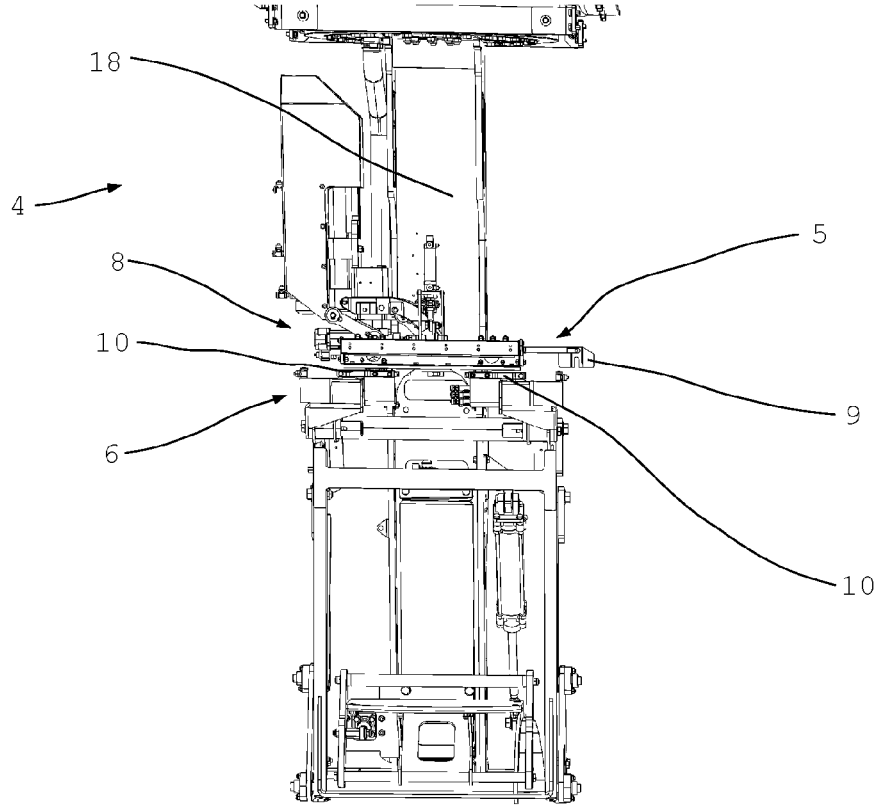
FIG. 15 shows a further purely schematic diagram of an exemplary embodiment of a transfer device.
Figure 16:
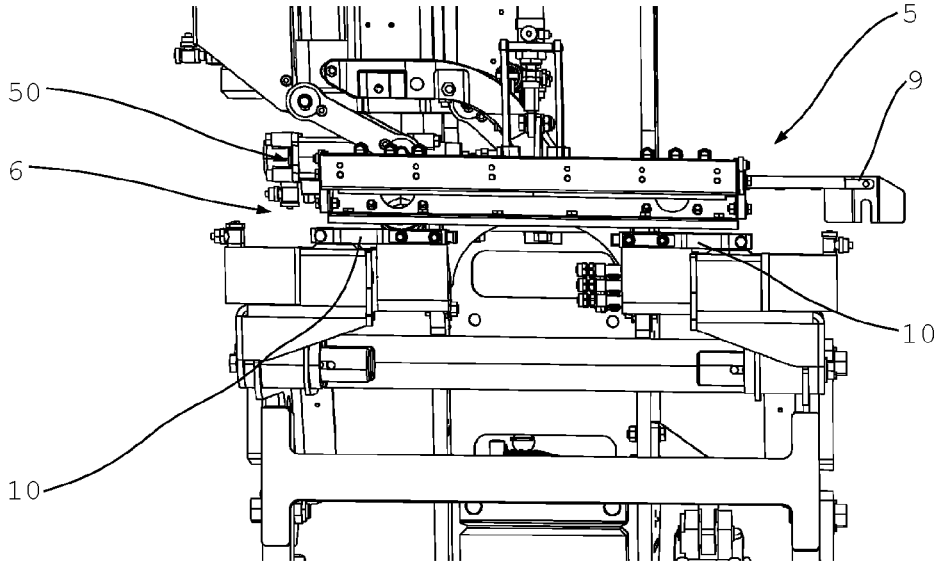
FIG. 16 shows an enlargement according to FIG. 15.

In FIGS. 15 and 16, the base body of the transfer device 4 is rotated in such a manner that the first gripper device 5 is aligned in the direction of the filling nozzle 101 of the filling module 100. In this position, an open bag not shown is held on the gripper arms 9 in the exemplary embodiment shown here by spreading the two gripper arms 9, wherein the gripper device 5 is displaced forwards to attach the bag which is held open to the filling nozzle 101. In addition, the second gripper device 6 with the clamping devices 10 can be identified.

Figure 17:
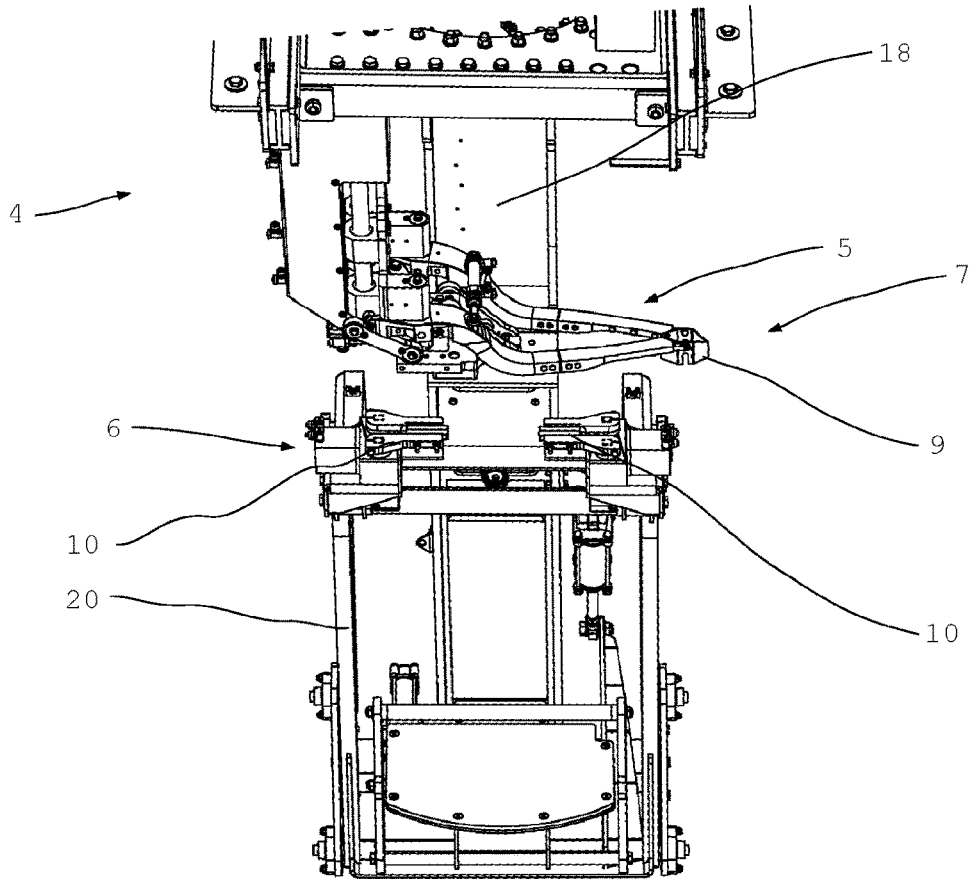
FIG. 17 shows a perspective view according to the view from FIG. 15.
Figure 18:
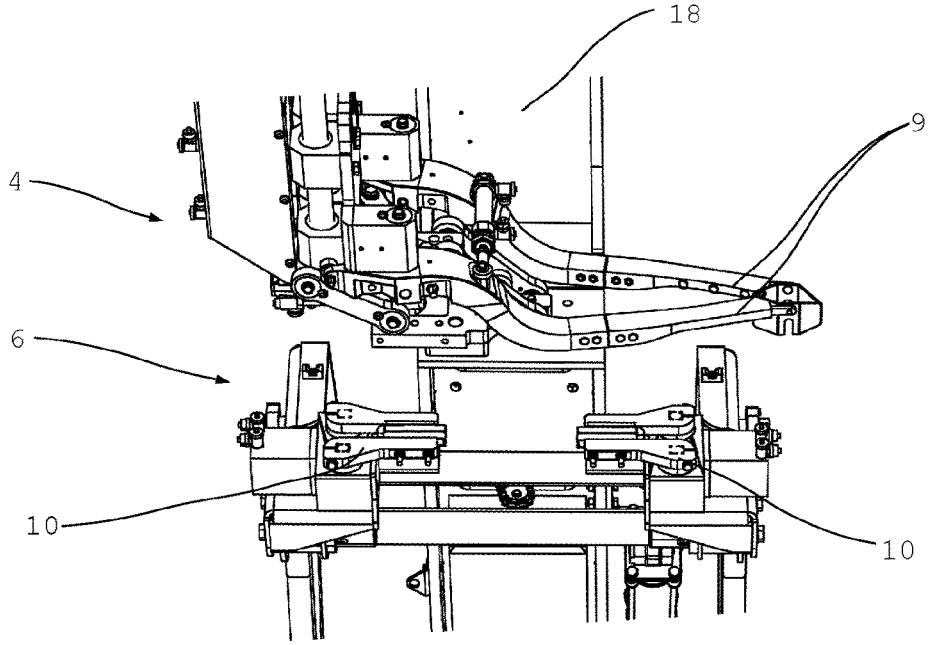
FIG. 18 shows an enlargement according to FIG. 17.

FIGS. 17 and 18 show the side view from FIGS. 15 and 16 again in a slightly perspective view from obliquely above, wherein in addition the cleaning device 50 above the second gripper device 6 is hidden in order to get a better impression of the clamping devices 10 of the second gripper device 6.

In FIGS. 19 to 24, the cleaning device 50 according to the invention provided above the second gripper device 6 in the exemplary embodiment shown here and its mode of operation is described in detail.

In this case, the cleaning device 50 according to the invention in the exemplary embodiment shown here is provided for cleaning the so-called head seam area of a bag to be closed by means of blown out air.

In addition to the application of the cleaning device 50 presented here, this can also clean any other work section, in particular in relation to the packing machine 1 described here.

Figure 19:
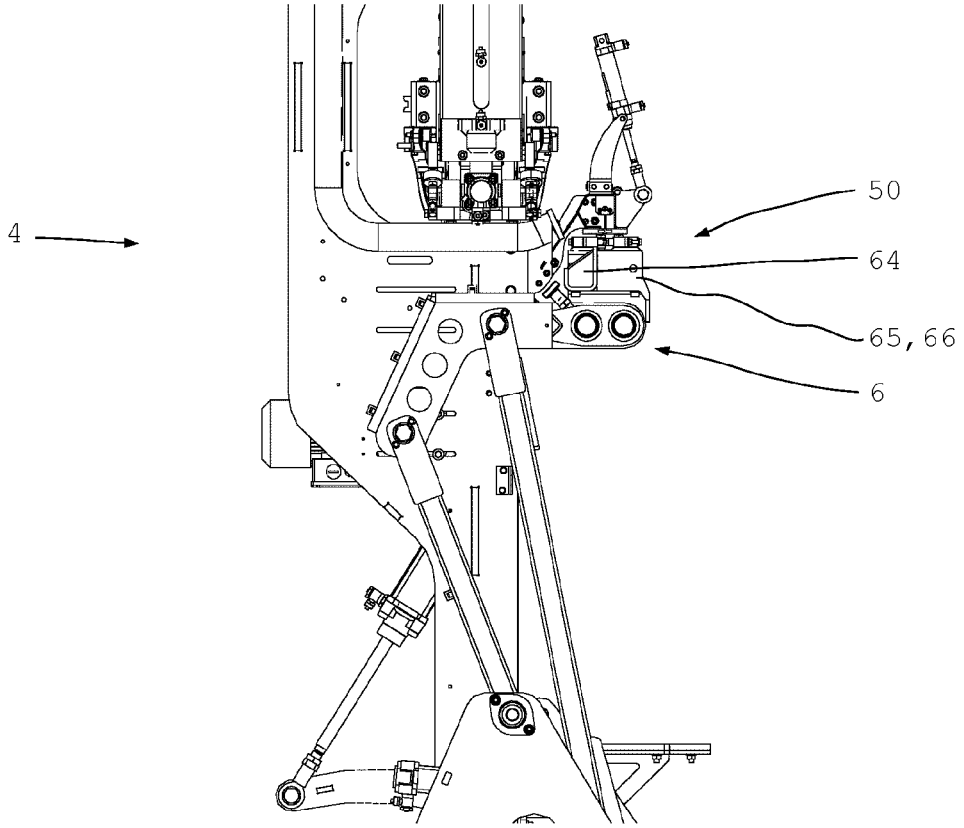
FIG. 19 shows a purely schematic view of an exemplary embodiment of a transfer device with a cleaning device according to the invention.

FIG. 19 shows an overview view of the transfer device 4 of the packing machine 1 according to the invention purely schematically, wherein in the exemplary embodiment shown here the cleaning device 50 according to the invention is arranged above the second gripper device 6.

In this exemplary embodiment, the cleaning device 50 comprises two blowing strips 51 which cannot be seen in FIG. 19. The cleaning device 50 is provided encapsulated in the exemplary embodiment shown here namely in a housing device 64. This makes it possible to achieve a hermetic sealing of the blowing strips 51 and the work section to be cleaned. In order to feed the work section to be cleaned or the bag to the cleaning device 50, the housing device 64 comprises a movable or, in this case, pivotable housing element 65 or a flap 66, which is shown in the closed state in the view shown.

Figure 20:
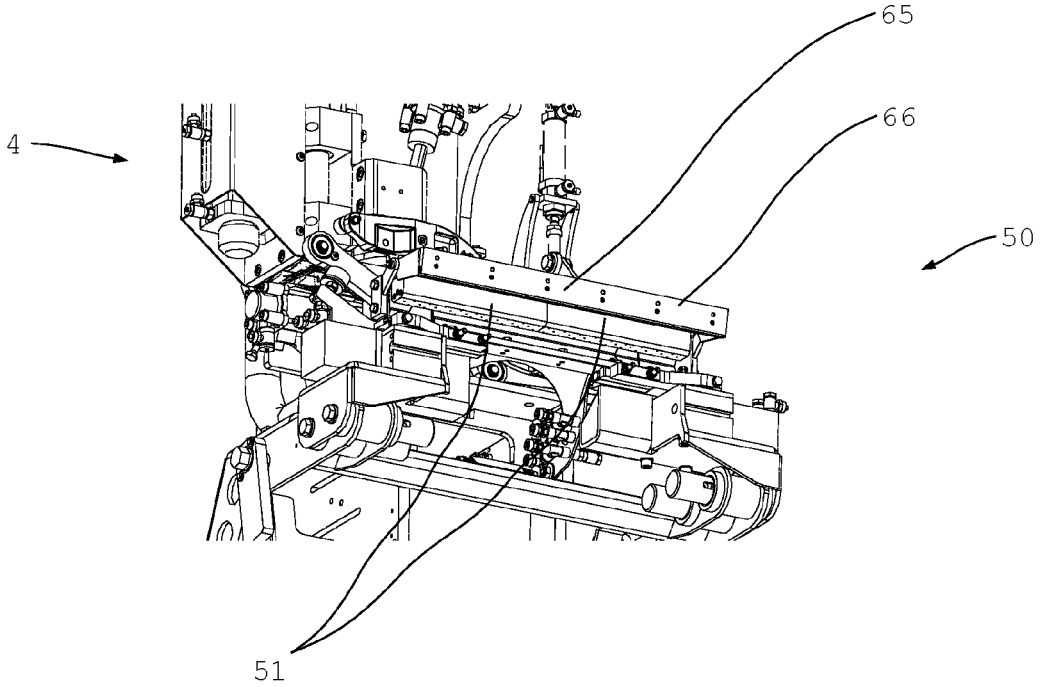
FIG. 20 shows a purely schematic diagram of a cleaning device according to the invention in a perspective view.

FIG. 20 shows in a perspective view a cleaning device according to the invention 50, wherein the movable housing element 65 or the flap 66 is shown in the open state. Thus, the view of the two blowing strips 51 located inside the housing device 64, shown here as an example, is free.

Figure 21:
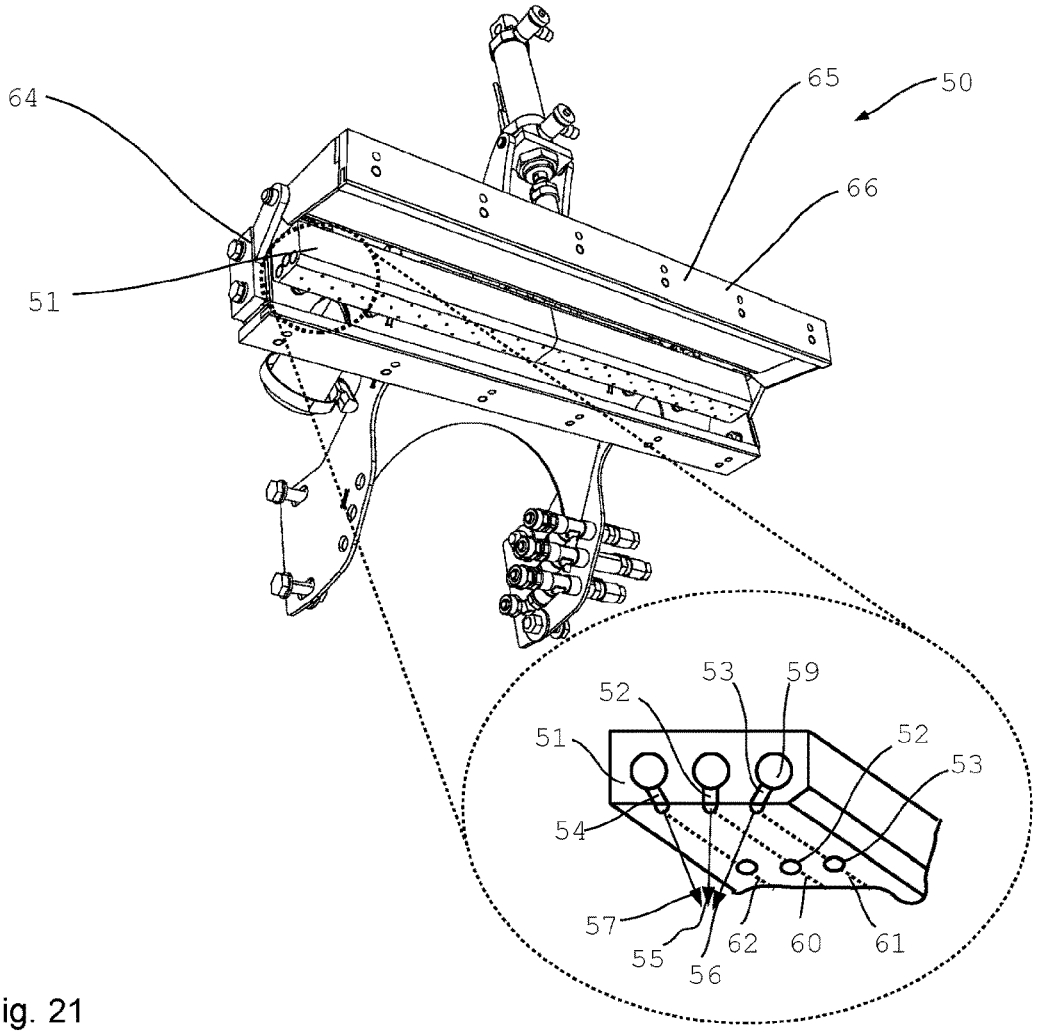
FIG. 21 shows a further purely schematic diagram of a cleaning device according to the invention in a perspective view.
Figure 22:
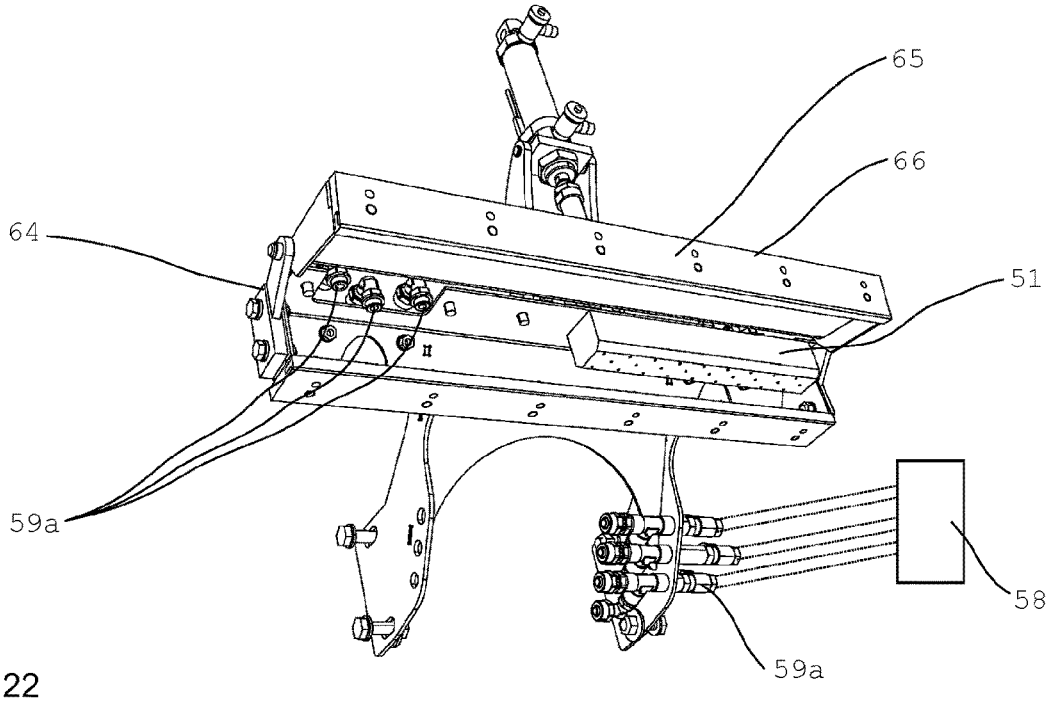
FIG. 22 shows a next purely schematic diagram of a cleaning device according to the invention in a perspective view.

In FIG. 21 in a perspective view, the assembly of the cleaning device 50 is shown separately in a perspective view. Here also, the flap 66 or the pivotable housing element 65 is shown in the open state, so that the two blowing strips 51 provided in the exemplary embodiment shown here can be seen.

In the exemplary embodiment shown here, the blowing strips 51 each comprise a plurality of first nozzle devices 52, second nozzle devices 53 and third nozzle devices 54, which are arranged here in rows 60, 61, 62.

In this case, the three rows 60, 61, 62 of the first nozzle devices 52, the second nozzle devices 53 and the third nozzle devices 54 can be supplied differently with air so that a moving air wave is blown out over the work section to be cleaned.

This is achieved whereby the first nozzle devices 52 or the first row 60 of first nozzle devices 52 each have a first blowing-out direction 55, which differs from the blowing-out directions 56, 57 of the other nozzle devices 53, 54 or rows 61, 62 of nozzle devices 53, 54. In particular, it is preferred and also provided in this exemplary embodiment that the first nozzle devices 52, the second nozzle devices 53 and the third nozzle devices 54 each have a blowing-out direction 50, 56, 57, which each differ from one another.

Furthermore, a control device 58 not shown in more detail in the figures is provided, which is suitable and configured to control the nozzle devices 52, 53, 54 at least at times in a temporally staggered manner For this purpose, it is provided in the exemplary embodiment shown that for the three rows 60, 61, 62 of nozzle devices 52, 53, 54 separate air supplies 59 are provided in each case within the blowing strips 51. This is provided here for both blowing strips 51 and can be identified in FIG. 22 purely schematically by hiding the left blowing strip 51. By hiding the one blowing strip 51 the separate air supplies 59*a* or the connections for the air supplies 59 of the blowing strip 51 located outside the blowing strip 51 can be seen.

Figure 23:
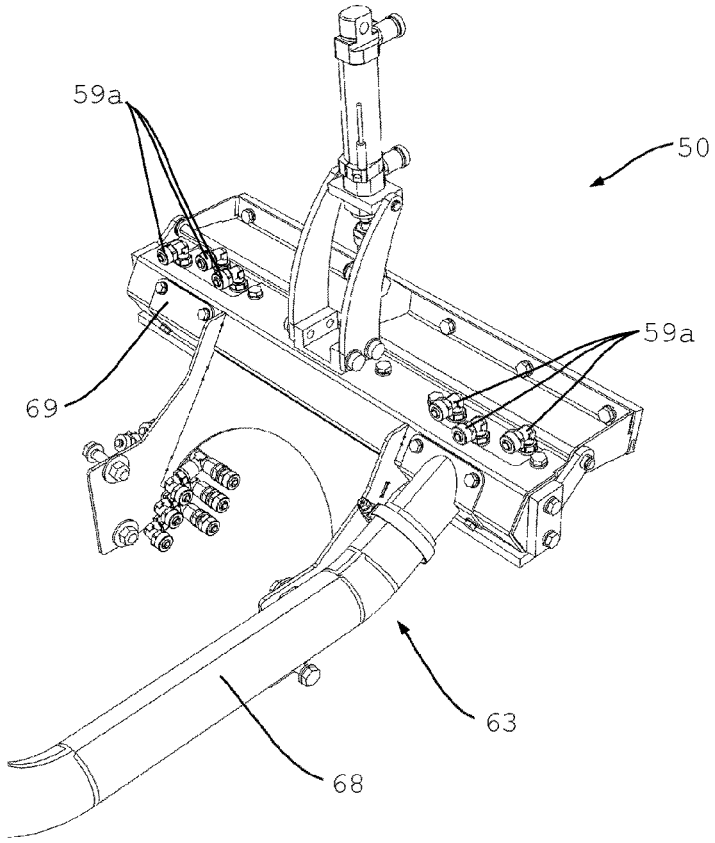
FIG. 23 shows another purely schematic diagram of a cleaning device according to the invention in a perspective view.
Figure 24:
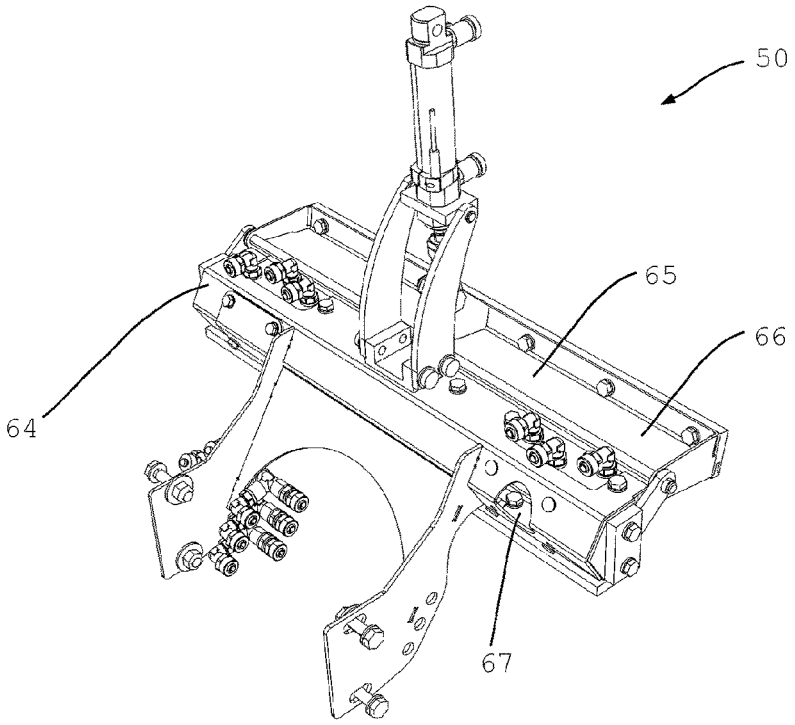
FIG. 24 shows a further purely schematic diagram of a cleaning device according to the invention in a perspective view.

FIGS. 23 and 24 show purely schematically that an extraction device 63 can also be provided to extract the air expelled by the blowing strips 51 or another fluid together with the swirled particles.

For this purpose, in the exemplary embodiment shown here the extraction device 63 is in operative connection with the interior of the housing device 64 via an opening 67 in the housing device 64.

In the exemplary embodiment shown, a suction pipe 68 is provided, which is connected to this opening 67. Depending on the configuration, for example, a further suction pipe 68 can be provided on the left side, wherein here the opening 67 is closed on the left side by a cover 69.

In the exemplary embodiment shown, as has already been described previously, it is provided that a hermetically substantially sealed cleaning space is created by closing the movable housing element 65 or the flap 66 of the housing device 64. Depending on the application, the extraction device is then set so that at least the air volume or generally the volume which is blown into the housing 64 through the blowing strips 51 is extracted. In particular, it is preferred that at least so much is extracted that at least a small vacuum is created inside the housing device 64. This is particularly important for systems that are used in dust explosion areas. In non-critical working environments or in general, a non-hermetically closing housing device 64 or even no housing device 64 can be provided.

In FIGS. 23 and 24 it can also be seen once again that the different rows 60, 61, 62 of the first, second and third nozzle devices 52, 53, 54 are connected via different air supply lines 59*a* per blowing strip 51.

Thus, the different control of the individual nozzle devices 52, 53, 54 or the individual rows 60, 61, 62 of these nozzle devices 52, 53, 54 is also possible differently per blowing strip 51. Thus, in the exemplary embodiment shown, an air wave or a moving air stream can be generated over the entire length and also over the width of the work section to be cleaned, whereby in particular the outlet pattern of a pendulum nozzle is modelled without using moving parts. In this case, in the blow-out pattern of a pendulum nozzle it is achieved that when cleaning the bag section for the subsequent head seam, the bag walls to be joined subsequently are blown apart so that product located between the bag walls is removed.

In particular, by means of an oscillating air jet it is achieved that when cleaning the bag mouth edge before closing or welding the filled bag by the moving air flow, the bag walls or film layers located on top of one another are opened by the acting air jet, so that the air jet impinges upon the inner surfaces, whereby the adhering dust or dirt particles are removed here. By changing the air jet, the layers of the side folds are also separated from each other with a corresponding design of the bag, so that this area is also cleaned. The individual film layers are as it were opened one after the other by the moving or oscillating air flow and cleaned by the air flow thus penetrating.

In FIGS. 25 to 29, the transfer of a filled bag by the transfer device 4 or a displacement device 200 according to the invention to the bag removal 3 is shown purely schematically.

In this case, a substantially parallelogram-like structure 20 is provided, on which in the exemplary embodiment of a displacement device 200 according to the invention shown here as handling device 250 the second gripper device 6 with the clamping devices 10 is provided. This structure 20 is also used to remove the full bag from the filling nozzle 101 or to bring the second gripper device 6 into contact with the filled bag.

Figure 25:
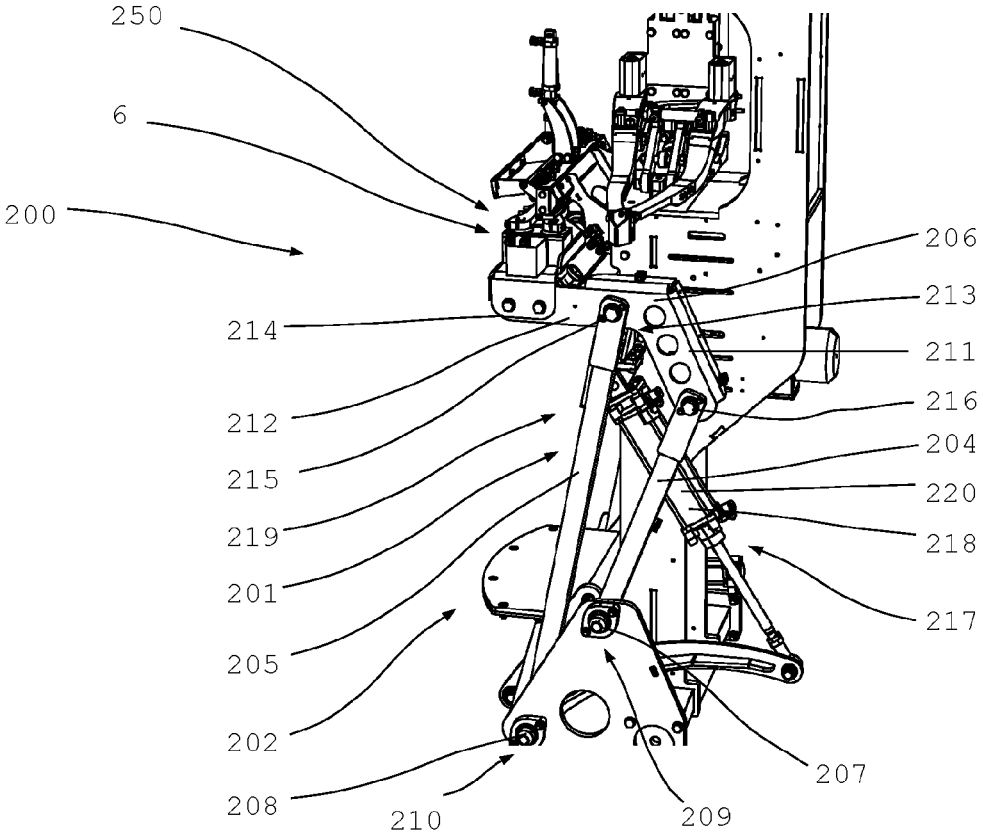
FIG. 25 shows a purely schematic diagram of an exemplary embodiment of a transfer device and a bag removal of a packing system according to the invention or a displacement device according to the invention in a perspective view.

FIG. 25 shows a displacement device 200 according to the invention in a purely schematic perspective view in order to describe in more detail the structure of the parallelogram-like structure 20. In this case, the displacement device 200 here in the form of handling device 250 comprises the second gripper device 6 which in the previously described packing machine 1 removes the filled bag from the filling nozzle and feeds it to a closure device 15.

In this case, the displacement device comprises an articulation mechanism 201 on which the handling device 250 or processing device or in the exemplary embodiment shown here, the second gripper device 6 is attached.

In the exemplary embodiment shown here, the articulation mechanism 201 is configured as a four-pivot arrangement 219 which comprises a first link 204 and a second link 205, which are connected by a coupler 206 in the upper region.

The first link 204 and the second link 205 are each received in an articulated manner at their lower articulation point 207, 208 on a housing. The upper two articulation points 215, 216 are connected to the coupler 206 in an articulated manner.

In order to achieve the desired rectilinear or substantially rectilinear displacement of the handling device 215, the length and the arrangement of the first link 204 and the second link 205 on the coupler 206 are geometrically matched to one another.

To this end, in this exemplary embodiment the coupler 206 has a first section 211 and a second section 212 which are arranged at an angle with respect to one another at 113. In this case, the first link 204 is received on the first section 211 and the second link 205 on the second section 212.

The second section 212 is here configured and arranged substantially horizontally and offers a receiving section 214 for receiving the handling device 250 or, in the exemplary embodiment shown here, for receiving the second gripper device 6.

In the exemplary embodiment shown here, the first link 204 is configured to be shorter than the second link 205 wherein the lower or first articulation point 207 of the first link 204 is arranged to be higher than the lower or first articulation point 208 of the second link 205.

Furthermore, in the exemplary embodiment shown here the upper articulation point or the second articulation point 215 of the first link 204 is provided at a lower height or lower than the second articulation point 216 of the second link 205.

The dimensioning and the arrangement of the links 204, 205 and the coupler 206 and due to the special attachment of the links 204, 205 and the handling device 250 on the coupler 206, the inventive and preferably substantially rectilinear displacement of the handling device 250 is made possible by the movement of the articulation mechanism 201 from the first position 202 into the second position 203.

Furthermore it can be seen that in the exemplary embodiment shown, an actuator device 217 is provided in order to displace the articulation mechanism 201 and therefore the handling device 250 from the first position 202 into the second position 203 and back.

In this case, in the exemplary embodiment shown here the actuator device 217 comprises a pneumatic device 218 which here comprises a pneumatic cylinder 220.

Figure 26:
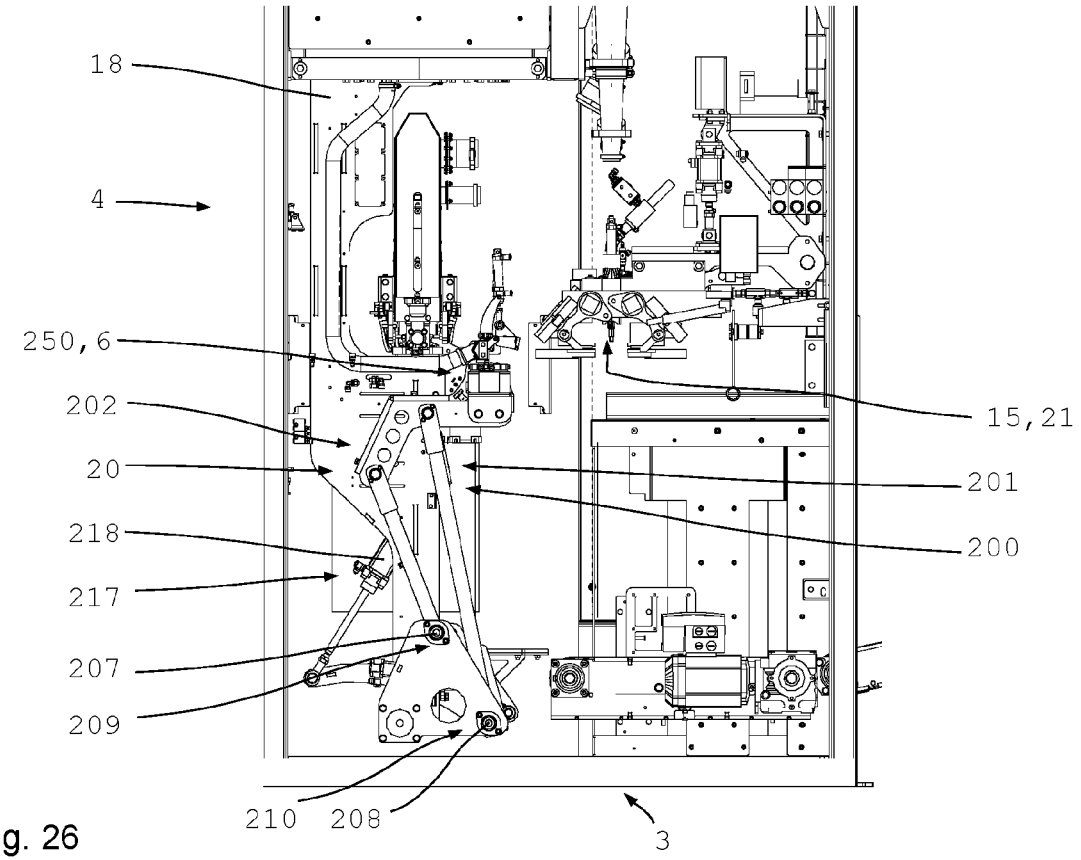
FIG. 26 shows a purely schematic diagram of an exemplary embodiment of a transfer device and a bag removal of a packing system according to the invention or a displacement device according to the invention in a front view.
Figure 27:
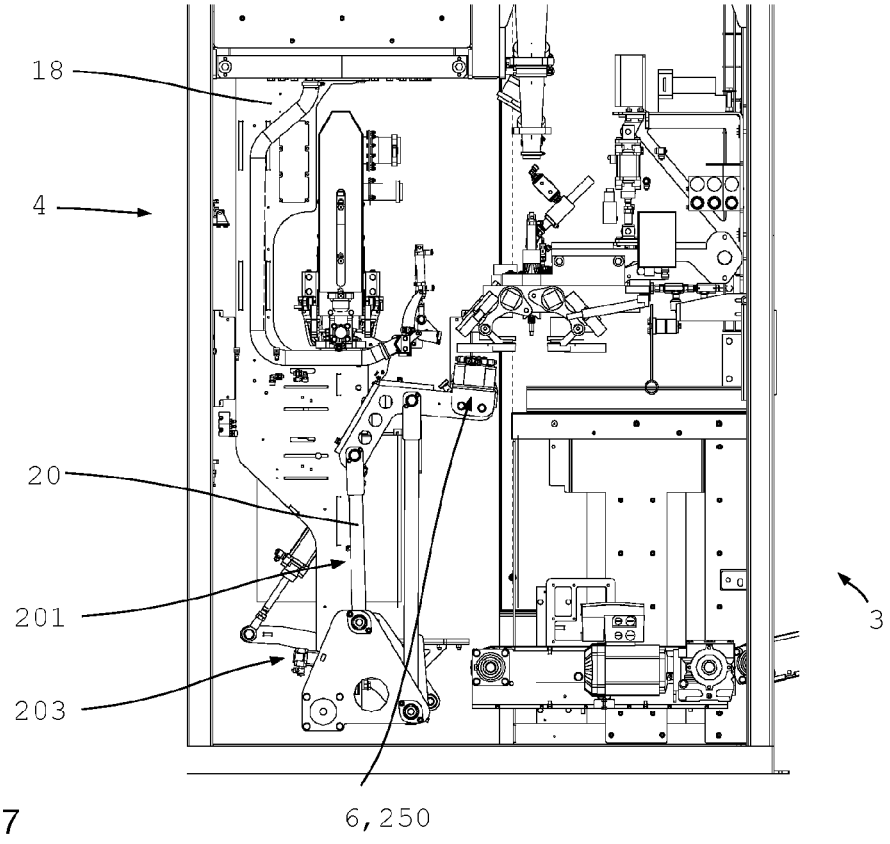
FIG. 27 shows a further purely schematic diagram of an exemplary embodiment of a transfer device and a bag removal of a packing system according to the invention or a displacement device according to the invention in a front view.
Figure 28:
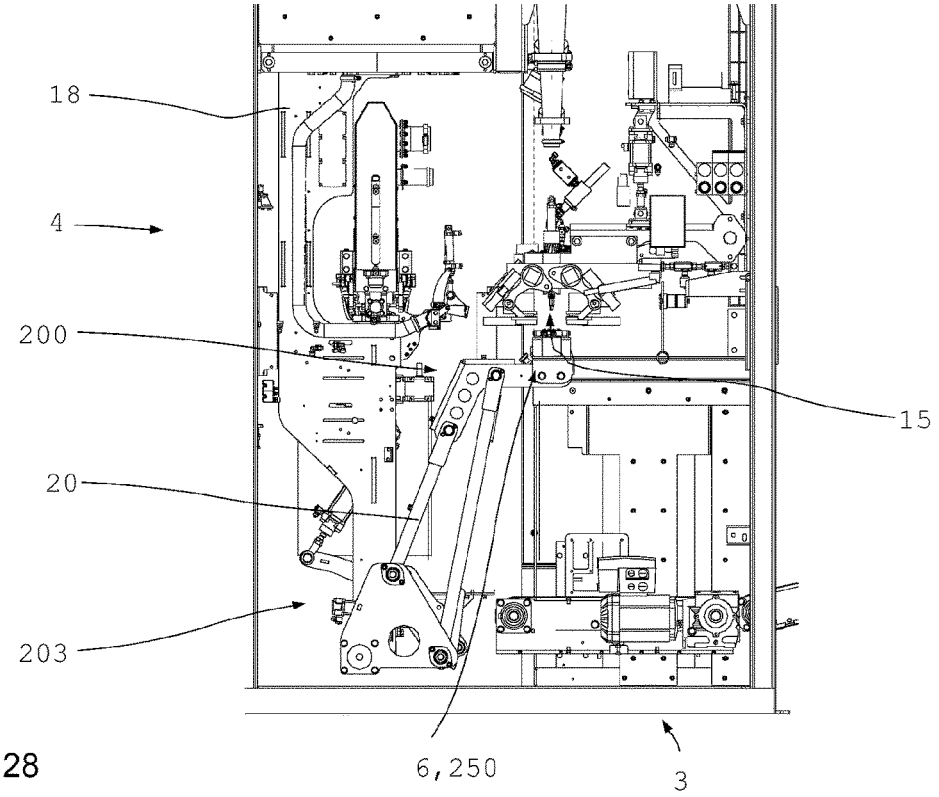
FIG. 28 shows a next purely schematic diagram of an exemplary embodiment of a transfer device and a bag removal of a packing system according to the invention or a displacement device according to the invention in a front view.

In the basic state, which is shown in FIGS. 25 and 26, in the exemplary embodiment shown here the handling device 250 or the second gripper device 6 in the first position 202 abuts relatively closely against the base body 18 of the transfer device 4. In the following FIGS. 27 and 28 it can be seen how the second gripper device 6 moves forward in the direction of the bag removal 3 via an intermediate position (FIG. 27) into the second position 203 (FIG. 28) by displacing the parallelogram-like structure 20.

In this case, the closure device 15 can also be seen here, which is configured as a welding station 21 in the exemplary embodiment shown here.

Figure 29:
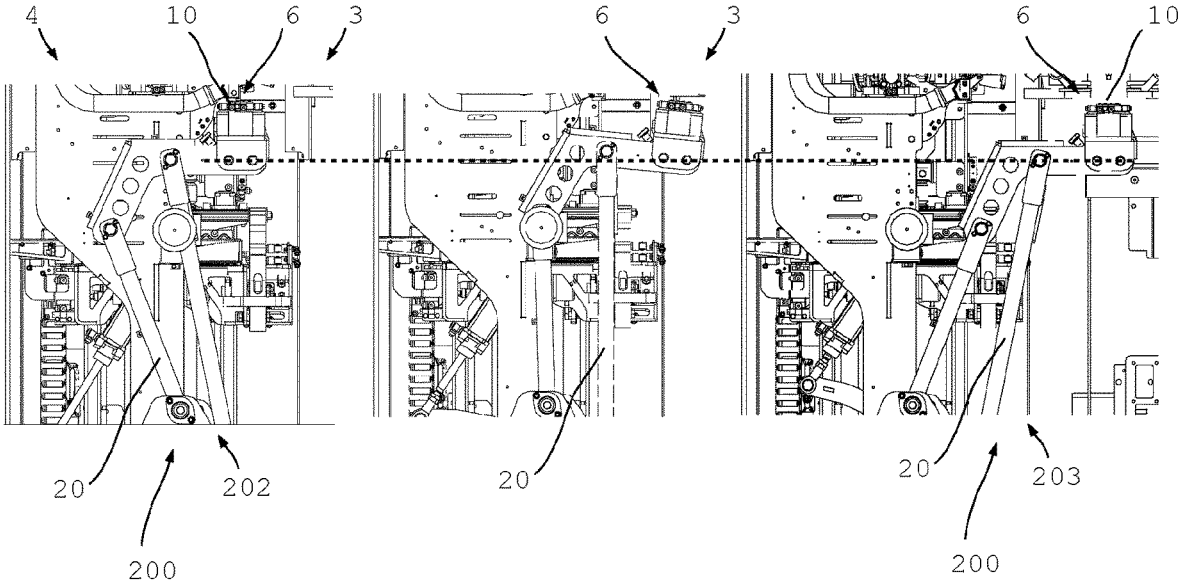
FIG. 29 shows sections from FIGS. 27, 28 and 29.
Figure 30:
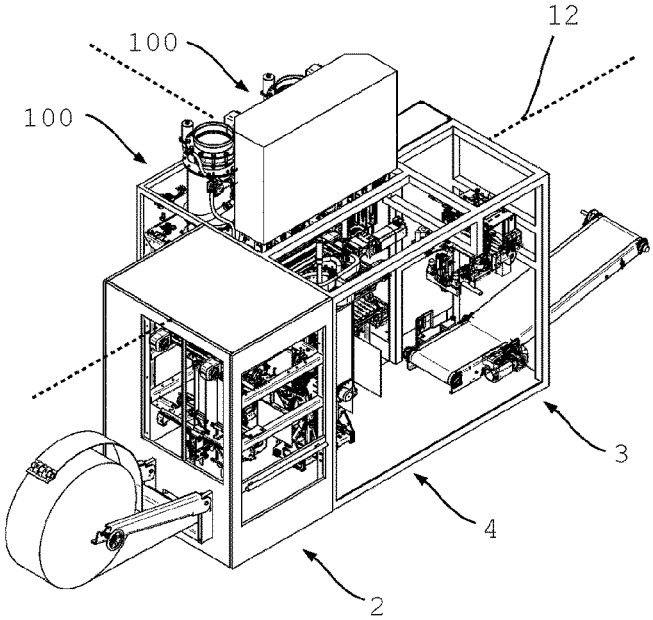
FIG. 30 shows a next exemplary embodiment of a packing machine according to the invention in a perspective view.
Figure 31:
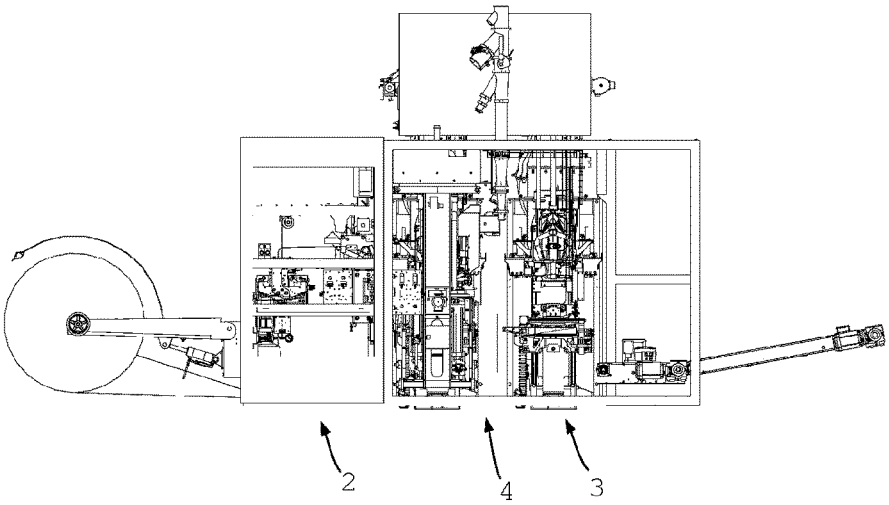
FIG. 31 shows the exemplary embodiment according to FIG. 30 in a front view.
Figure 32:
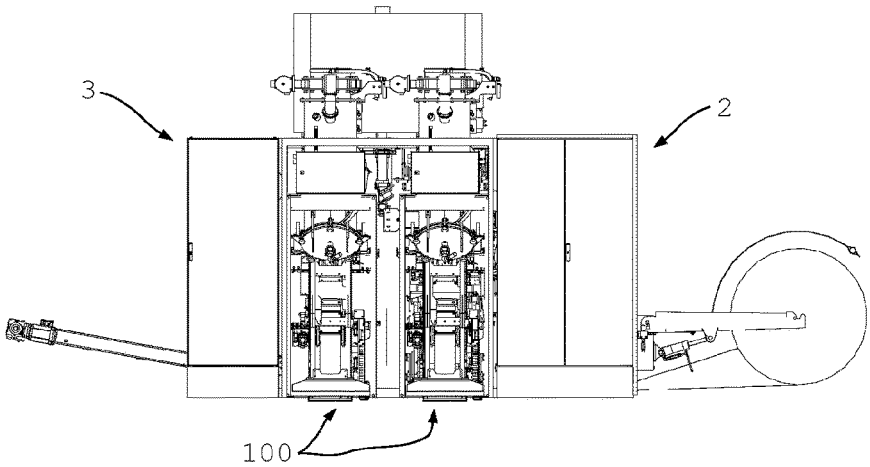
FIG. 32 shows the exemplary embodiment according to FIG. 30 in a rear view.
Figure 33:
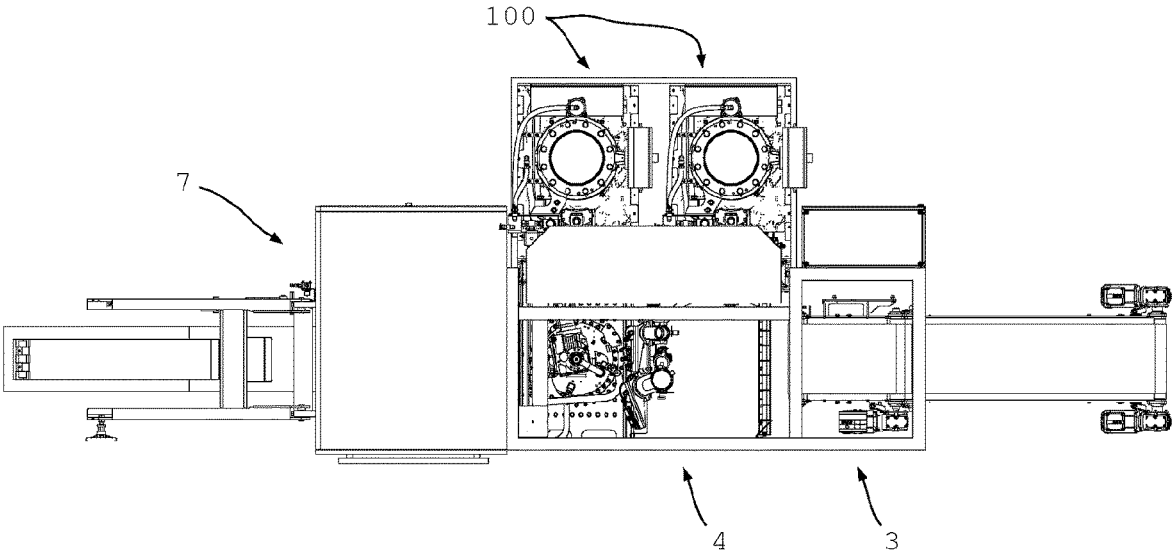
FIG. 33 shows the exemplary embodiment according to FIG. 30 in a plan view.
Figure 34:
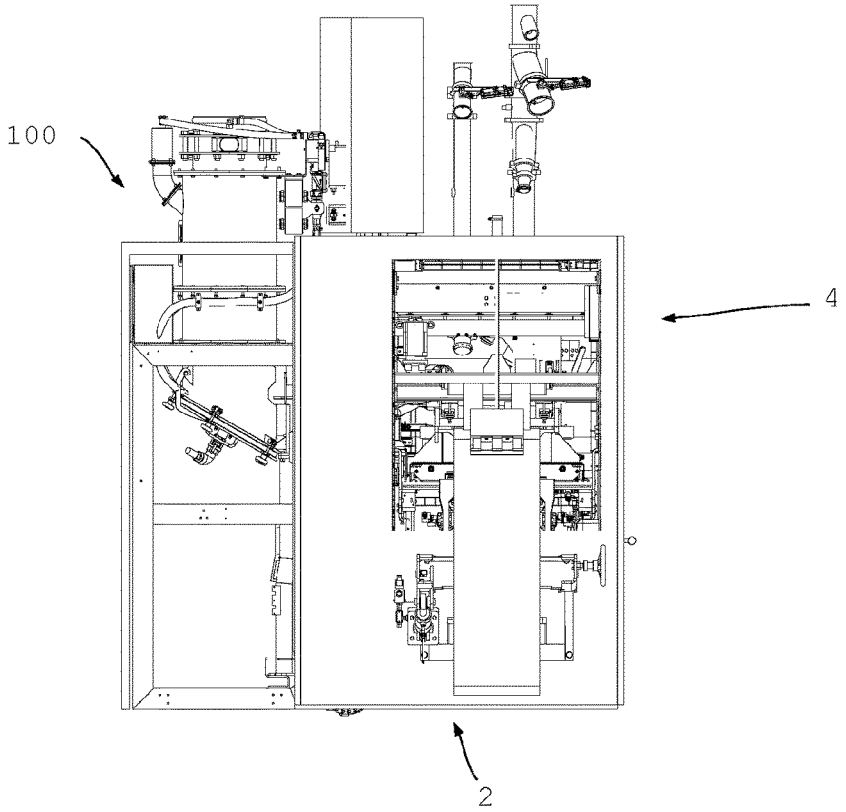
FIG. 34 shows the exemplary embodiment according to FIG. 30 in a side view.

FIG. 29 shows purely schematically by the side-by-side representation of the individual positions of the parallelogram-like structure 20 that due to the special configuration of this parallelogram-like structure 20, the filled bag is transferred by means of gripper device 6 of the transfer device 4 approximately on a line or approximately rectilinearly to the bag removal 3 without any lifting movement.

Thus, in the embodiment of a displacement device 200 according to the invention shown here in a packing machine according to the invention, it can be achieved that during transfer to the closure device 15 and/or to the bag removal the filled bag is not exposed to any lifting movement as is otherwise the case in conventional systems even with an articulation mechanism in the manner of a parallelogram due to the polygon effect. During the movement of the handling device in known systems this results in a raising and lowering of the handling device with the result that these forces act on the bag attached to the handling device 250 or to the second gripper device 6. As a result, in the known displacement systems the volume of the bag interior changes briefly which results in escape of product or dust and therefore in contamination of the previously cleaned bag.

Due to the special configuration of the articulation mechanism the transport path is accomplished substantially rectilinearly, here horizontally wherein however the handling device 250 can tilt slightly here on the displacement device 250, which however does not result in a change in the lift or the vertical alignment. In this case, the articulation mechanism 201 is matched to one another or configured here in such a manner that a point of the coupler or the second section 212 of the coupler 206 is linear. The remainder tilts slightly about this point depending on position.

FIGS. 30 to 34 show a further exemplary embodiment of a packing machine 1 according to the invention. In this case, the configuration of this exemplary embodiment substantially corresponds to the exemplary embodiment already described.

In particular, the bag supply 2, the transfer device 4 and the bag removal 3 are arranged in a line 12. In contrast to the exemplary embodiment shown previously, not just one filling module 100 is pulled out of the line 12 and arranged next to the transfer device 4 but two filling modules 100 are arranged side by side outside the line 12.

In order to select which of the two filling modules 100 is used, in the exemplary embodiment shown here the transfer device 4 is provided to be movable so that this can be arranged either in front of one or the other filling module 100. For example, a quick product change or maintenance of a filling module 100 can be carried out, for which the transfer device 4 can be pushed or moved in front of the filling module 100 to be used or not to be maintained.

At the same time as the transfer device 4 can be displaced in the line 12, depending on the configuration, a movability or a displaceability of the transfer device 4 transverse to the line 12 can also be provided as in the exemplary embodiments shown previously.

In order to ensure a reliable picking up of bags from the bag supply 2 and a reliable delivery of the filled bags by the transfer device 4 to the bag removal 3, the individual components of the transfer device 4 can accordingly be provided to be displaceable.

Depending on the configuration, however, the bag supply 2 and/or the bag removal 3 can also be co-displaced so that there are always optimal distances between the individual assemblies.

While particular embodiments of the present displacement device and method for displacement have been described herein, it will be appreciated by those skilled in the art that changes and modifications may be made thereto without departing from the invention in its broader aspects and as set forth in the following claims.

| Reference list | |
|---|---|
| 1 | Packing machine |
| 2 | Bag supply |
| 3 | Bag removal |
| 4 | Transfer device |
| 5 | First gripper device |
| 6 | Second gripper device |
| 7 | Side |
| 8 | Side |
| 9 | Gripper arm |
| 10 | Clamping device |
| 11 | Housing device |
| 12 | Line |
| 13 | Bag production |
| 14 | Film supply |
| 15 | Closure device |
| 16 | Conveyor belt |
| 17 | Housing cover |
| 18 | Base body |
| 19 | Rail |
| 20 | Parallelogram-like structure |
| 21 | Welding station |
| 50 | Cleaning apparatus |
| 51 | Blowing strip |
| 52 | First nozzle device |
| 53 | Second nozzle device |
| 54 | Third nozzle device |
| 55 | Blowing-out direction |
| 56 | Blowing-out direction |
| 57 | Blowing-out direction |
| 58 | Control device |
| 59 | Air supply |
| 59a | Air supply |
| 60 | Row |
| 61 | Row |
| 62 | Row |
| 63 | Suction device |
| 64 | Housing device |
| 65 | Housing element |
| 66 | Flap |
| 67 | Opening |
| 68 | Suction pipe |
| 69 | Cover |
| 100 | Filling module |
| 101 | Filling nozzle |
| 102 | Housing device |
| 103 | Housing cover |
| 104 | Inlet hopper |
| 105 | Air filling module |
| 106 | Pressure chamber |
| 200 | Displacement device |
| 201 | Articulation mechanism |
| 202 | First position |
| 203 | Second position |
| 204 | First link |
| 205 | Second link |
| 206 | Coupler |
| 207 | Lower articulation point |
| 208 | Lower articulation point |
| 209 | Height |
| 210 | Height |
| 211 | First section |
| 212 | Second section |
| 213 | Angle |
| 214 | Receiving section |
| 215 | Second articulation point |

-continued

| Reference list | |
|---|---|
| 216 | Second articulation point |
| 217 | Actuator device |
| 218 | Pneumatic device |
| 219 | Four-pivot arrangement |
| 220 | Pneumatic cylinder |
| 250 | Processing device |

The invention claimed is:

1. A displacement device for at least one handling device of a packing machine, comprising:

at least one articulation mechanism on which the handling device is accommodated, wherein the handling device is displaceable by means of the articulation mechanism between at least one first position and at least one second position;

the articulation mechanism comprises at least one four-pivot arrangement with at least one first link and at least one second link, wherein the first link is connected to the second link via at least one coupler;

and the at least one coupler comprises a receiving section for receiving the handling device, and at least one first section and a second section, wherein the first section and the second section are arranged at an angle relative to one another, and wherein the first link, the second link and the at least one coupler are matched to one another in such a manner that a substantially rectilinear displacement of the handling device takes place from the first position into the second position.

2. The displacement device according to claim 1, wherein the first link and the second link are different lengths.

3. The displacement device according to claim 1, wherein a lower articulation point of the first link and a lower articulation point of the second link are arranged at different heights.

4. The displacement device according to claim 1, wherein the first link with a second articulation point is received in an articulated manner on the first section of the at least one coupler, and wherein the second link with a second articulation point is received in an articulated manner on the second section or between the first section and the second section of the at least one coupler.

5. The displacement device according to claim 1, wherein the receiving section for receiving the handling device is arranged on the second section of the at least one coupler.

6. The displacement device according to claim 4, wherein the arrangement of the second articulation point of the first link on the first section and the second articulation point of the second link on the second section are matched to one another.

7. The displacement device according to claim 1, wherein at least one actuator device is provided.

8. The displacement device according to claim 7, wherein the actuator device comprises at least one pneumatic device.

9. A method for displacement of a handling device by means of a displacement device according to claim 1, wherein the handling device is displaced substantially rectilinearly by means of the articulation mechanism between the first position and the second position.

10. A packing machine for filling product into bags, comprising at least one filling module with at least one filling nozzle, at least one displacement device according to claim 1 and at least one handling device.

* * * * *